US011491386B2

(12) United States Patent
Bandini et al.

(10) Patent No.: US 11,491,386 B2
(45) Date of Patent: Nov. 8, 2022

(54) EXERCISE MACHINE WITH FACILITATED IDENTIFICATION OF ONE OR MORE CONTROL DEVICES OF SUCH AN EXERCISE MACHINE

(71) Applicant: TECHNOGYM S.p.A., Forli'-Cesena (IT)

(72) Inventors: Luca Bandini, Forli'-Cesena (IT); Dervis Pazzini, Forli'-Cesena (IT); Alessandro Del Monaco, Forli'-Cesena (IT); Mauro Fabbri, Forli'-Cesena (IT)

(73) Assignee: TECHNOGYM S.p.A., Forli'-Cesena (IT)

( * ) Notice: Subject to any disclaimer, the term of this patent is extended or adjusted under 35 U.S.C. 154(b) by 410 days.

(21) Appl. No.: 16/713,730

(22) Filed: Dec. 13, 2019

(65) Prior Publication Data

US 2020/0188760 A1 Jun. 18, 2020

(30) Foreign Application Priority Data

Dec. 13, 2018 (IT) ..... 102018000011070

(51) Int. Cl.
*A63B 71/06* (2006.01)
*A63B 22/06* (2006.01)
(Continued)

(52) U.S. Cl.
CPC ..... *A63B 71/0619* (2013.01); *A63B 22/0605* (2013.01); *A63B 24/0087* (2013.01);
(Continued)

(58) Field of Classification Search
CPC ..... A63B 71/0619; A63B 22/0605; A63B 24/0087; A63B 71/0622; A63B 2071/0675; A63B 2225/20; A63B 2225/74; A63B 2024/0081; A63B 2071/0627; A63B 2220/30; A63B 2220/801; A63B 2225/50; A63B 22/02; A63B 2230/06; F21V 3/00; F21Y 2107/30; F21Y 2115/10; G05G 1/105; G05G 9/047; H01H 25/04
See application file for complete search history.

(56) References Cited

U.S. PATENT DOCUMENTS 4,627,620 A 12/1986 Yang
5,645,509 A * 7/1997 Brewer ..... A63B 22/025 482/901

(Continued)

FOREIGN PATENT DOCUMENTS

EP 2 940 676 A1 11/2015

OTHER PUBLICATIONS

Italian Search Report for corresponding Italian Patent Application No. 102018000011070 dated Aug. 28, 2019, 9 pages.

*Primary Examiner* — Sundhara M Ganesan
(74) *Attorney, Agent, or Firm* — Merchant & Gould P.C.

(57) ABSTRACT

An exercise machine (100) used to perform physical activity includes at least one control device (1) which can be actuated by the user to impart a command to the exercise machine (100). The exercise machine (100) includes at least one lighting device (2), the at least one lighting device (2) being positioned on the exercise machine (100) so as to identify the at least one control device (1) with which the exercise machine (100) is provided when the at least one lighting device (2) is lit.

15 Claims, 14 Drawing Sheets

(51) Int. Cl.

| | |
|---|---|
| ***A63B 24/00*** | (2006.01) |
| ***F21V 3/00*** | (2015.01) |
| ***F21Y 107/30*** | (2016.01) |
| ***F21Y 115/10*** | (2016.01) |

(52) U.S. Cl.
CPC ..... *A63B 71/0622* (2013.01); *F21V 3/00* (2013.01); *A63B 2071/0675* (2013.01); *A63B 2225/20* (2013.01); *A63B 2225/74* (2020.08); *F21Y 2107/30* (2016.08); *F21Y 2115/10* (2016.08)

(56) References Cited

U.S. PATENT DOCUMENTS

| | | | | |
|---|---|---|---|---|
| 9,511,262 | B1 * | 12/2016 | DePompe | A63B 69/32 |
| 9,707,447 | B1 * | 7/2017 | Lopez Babodilla | A63B 22/025 |
| 9,782,625 | B1 * | 10/2017 | Blum | G06F 1/1632 |
| 10,816,177 | B1 * | 10/2020 | Bayerlein | A63B 71/0686 |
| 11,097,173 | B1 * | 8/2021 | Celenza, Jr. | A63B 63/083 |
| 2005/0070407 | A1 * | 3/2005 | Alessandri | A63B 21/0628 482/148 |
| 2008/0015058 | A1 * | 1/2008 | Noble | A63B 63/007 473/423 |
| 2008/0051228 | A1 * | 2/2008 | Harmon | A63B 69/0053 473/445 |
| 2010/0004098 | A1 * | 1/2010 | Hensley | A63B 69/0048 482/37 |
| 2011/0124468 | A1 * | 5/2011 | Incerti Fornaciari | A63B 19/04 482/8 |
| 2013/0015945 | A1 * | 1/2013 | Chang | G09G 3/06 340/4.31 |
| 2014/0221170 | A1 * | 8/2014 | Lin | A63B 21/4019 482/93 |
| 2014/0369695 | A1 * | 12/2014 | D'Andrade | A63B 24/0021 340/691.8 |
| 2017/0136339 | A1 * | 5/2017 | Habiche | A63B 22/0076 |
| 2017/0266503 | A1 * | 9/2017 | Watterson | A63B 69/0057 |
| 2018/0140903 | A1 | 5/2018 | Poure et al. | |
| 2019/0168067 | A1 * | 6/2019 | Bates | A63B 22/02 |
| 2019/0240540 | A1 * | 8/2019 | Wei | A63B 24/0062 |
| 2019/0351309 | A1 * | 11/2019 | Fima | A63B 71/0622 |
| 2020/0129837 | A1 * | 4/2020 | Liao | A63B 22/0285 |
| 2020/0171353 | A1 * | 6/2020 | Fima | A63B 71/0622 |
| 2020/0179768 | A1 * | 6/2020 | Osborn | A63B 43/008 |
| 2020/0222762 | A1 * | 7/2020 | King | A63B 71/0622 |
| 2020/0332990 | A1 * | 10/2020 | Bayerlein | A63B 24/0087 |
| 2020/0338382 | A1 * | 10/2020 | Kessler | F21V 23/0492 |
| 2021/0394014 | A1 * | 12/2021 | Fima | A63B 71/0622 |

* cited by examiner

EXERCISE MACHINE WITH FACILITATED IDENTIFICATION OF ONE OR MORE CONTROL DEVICES OF SUCH AN EXERCISE MACHINE

This application claims benefit of Ser. No. 102018000011070, filed 13 Dec. 2018 in Italy and which application is incorporated herein by reference. To the extent appropriate, a claim of priority is made to the above disclosed application.

FIELD OF THE INVENTION

The present invention relates to the field of fitness and, in particular, to an exercise machine with facilitated identification of one or more control devices of such an exercise machine.

Technological Background of the Invention

Typically, an exercise machine is equipped with one or more control devices (e.g. buttons, knobs, levers, etc.) to allow the user to be able to control the exercise machine by changing parameters and/or functions during the workout.

For example, in the case of a treadmill, such an exercise machine is usually provided with a first control lever, the actuation of which allows the user to increase or decrease the rotation speed of the treadmill, and a second control lever, the actuation of which allows the user to increase or decrease the gradient of the running surface.

The user must be able to identify these control levers easily during the workout in order to promptly impart the correct commands to the exercise machine to correctly follow a preset workout program on the exercise machine or commands imparted verbally by a personal trainer, obviously avoiding mistakes which could cause an incorrect performance of the workout, resulting in excessive efforts, excessive fatigue, injury or even falls.

Furthermore, if the workout is performed in the now widespread context of a workout class, not performing a command imparted vocally by the personal trainer of the class or performing it late may cause the user to lose the synchronization of their workout with that of other users with a consequent difficulty in performing the successive voice commands which may be imparted by the personal trainer, which in general may not be adequate for users who have accumulated delays in the performance of previous commands.

In view of this, the need for an exercise machine which allows a rapid and correct identification of the control devices distributed on the exercise machine is strongly felt.

In satisfying this need, it is of course also necessary to take into account the fact that tiredness and fatigue can affect the user's lucidity in the quick identification of such control devices and the fact that the user's gaze is typically as far forward as possible, both to maintain a correct posture and a stable balance during the workout and to constantly observe the personal trainer while the latter is providing voice commands or even useful indications on how to work out in the best manner. In addition, it is further worth noting that the user's gaze, during the workout, is mainly directed towards the display with which the exercise machine may be provided, to check the workout parameters or, if the workout is performed by the user remotely with respect to a class, to watch the video of a personal trainer either in real-time (live) or previously recorded.

Furthermore, it is also worth taking into account that, especially in the context of a workout class, the exercise machine may be in a deliberately dark environment or at least with dim or low lighting and this low lighting condition may make it more difficult to identify the control devices distributed on the exercise machine in timely fashion.

SUMMARY

It is the object of the present invention to devise and provide an exercise machine which allows solving, at least partially, the disadvantages described above with reference to the background art, in particular by allowing an identification as timely and as facilitated as possible of one or more control devices distributed on it.

A further object of the present invention is a method for identifying on an exercise machine one or more control devices of such an exercise machine.

BRIEF DESCRIPTION OF THE FIGURES

Further features and advantages of the exercise machine and of the method according to the invention will be apparent from the following description which illustrates preferred embodiments, given by way of indicative, non-limiting examples, with reference to the accompanying figures, in which.

It is worth noting that equivalent or similar elements are indicated by the same numerical and/or alphanumerical reference in the aforesaid figures.

DETAILED DESCRIPTION

An exercise machine 100 which can be used by a user to perform physical activity, according to the present invention, will now be described with reference to the aforesaid figures.

Figure 4B:
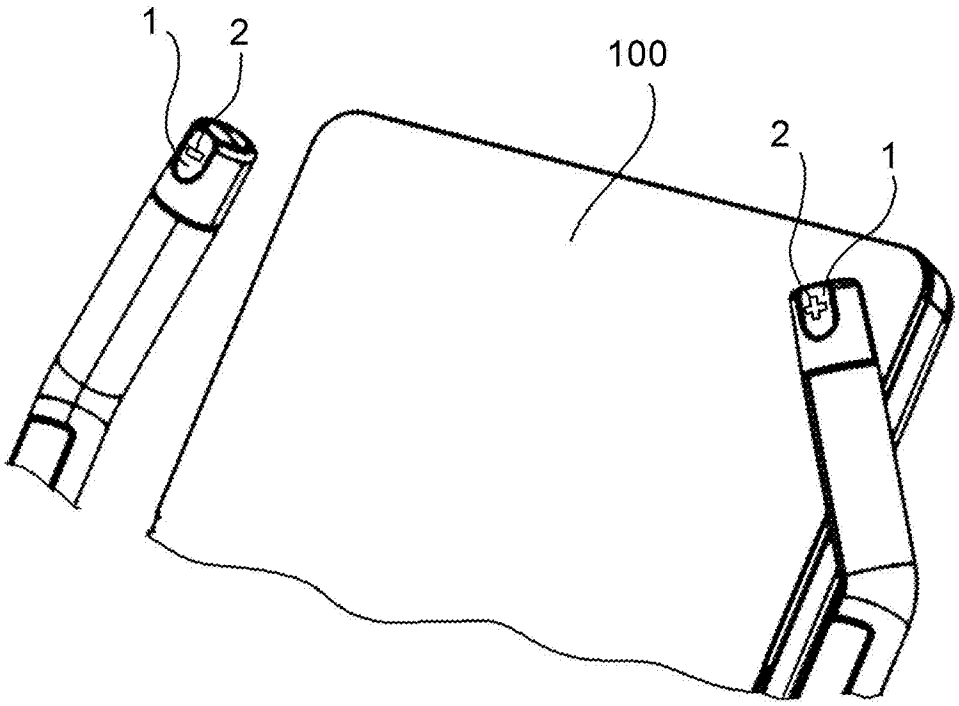
FIG. 4*b* shows an enlarged view of a portion of the exercise machine in FIG. 4*a;*
Figure 4A:
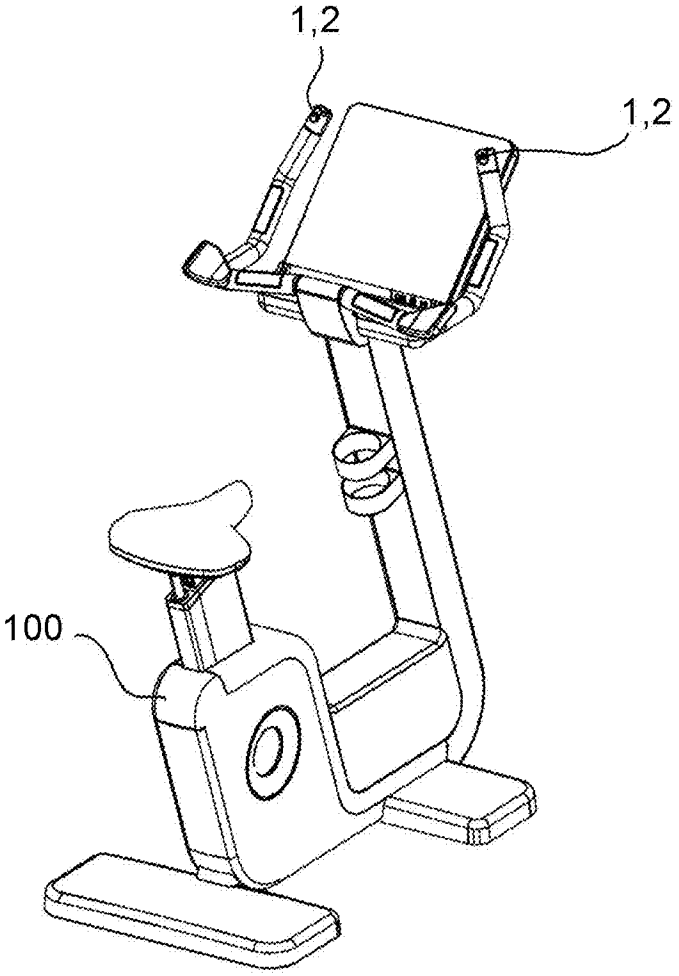
FIG. 4*a* shows a perspective view of an exercise machine according to an embodiment of the present invention.
Figure 5B:
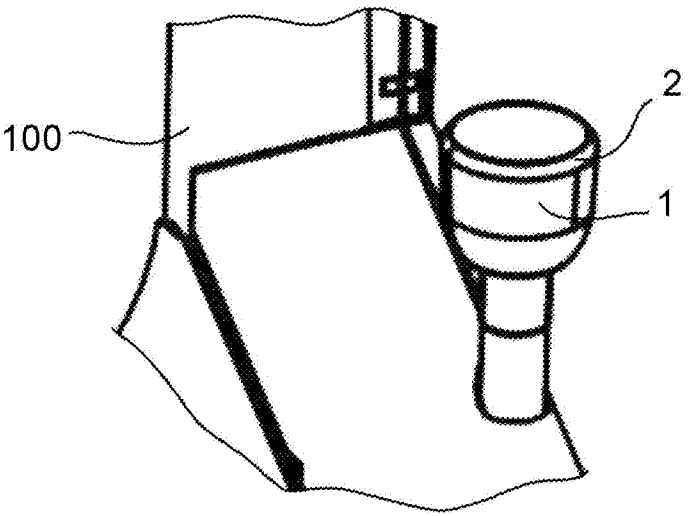
FIG. 5*b* shows an enlarged view of a portion of the exercise machine in FIG. 5*a;*
Figure 5A:
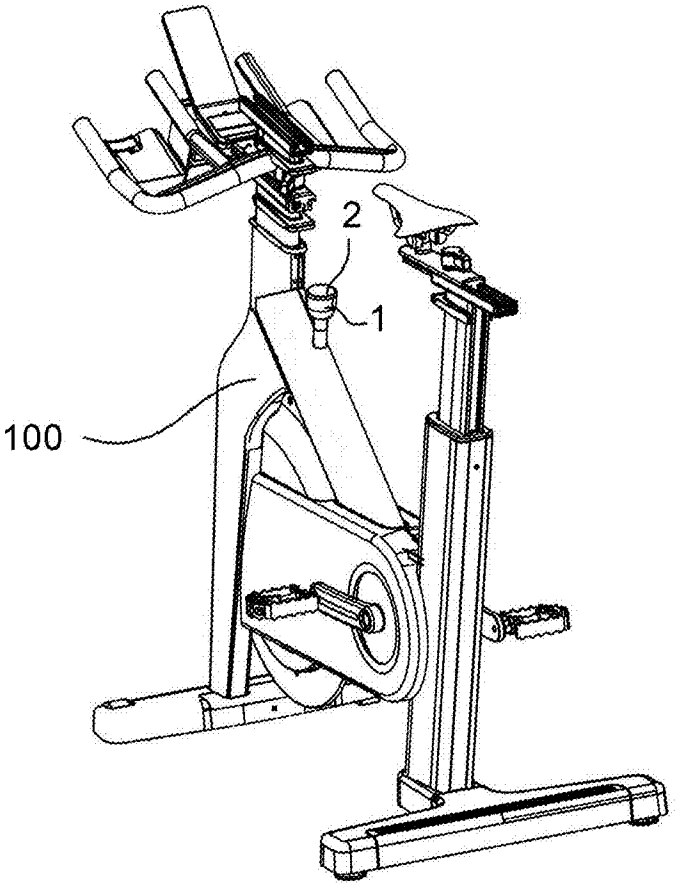
FIG. 5*a* shows a perspective view of an exercise machine according to an embodiment of the present invention.
Figure 6B:
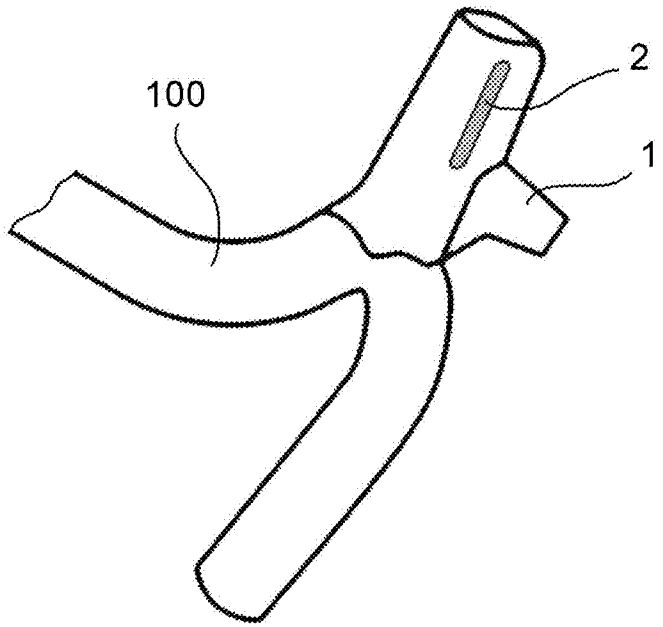
FIG. 6*b* shows an enlarged view of a portion of the exercise machine in FIG. 6*a;*
Figure 6A:
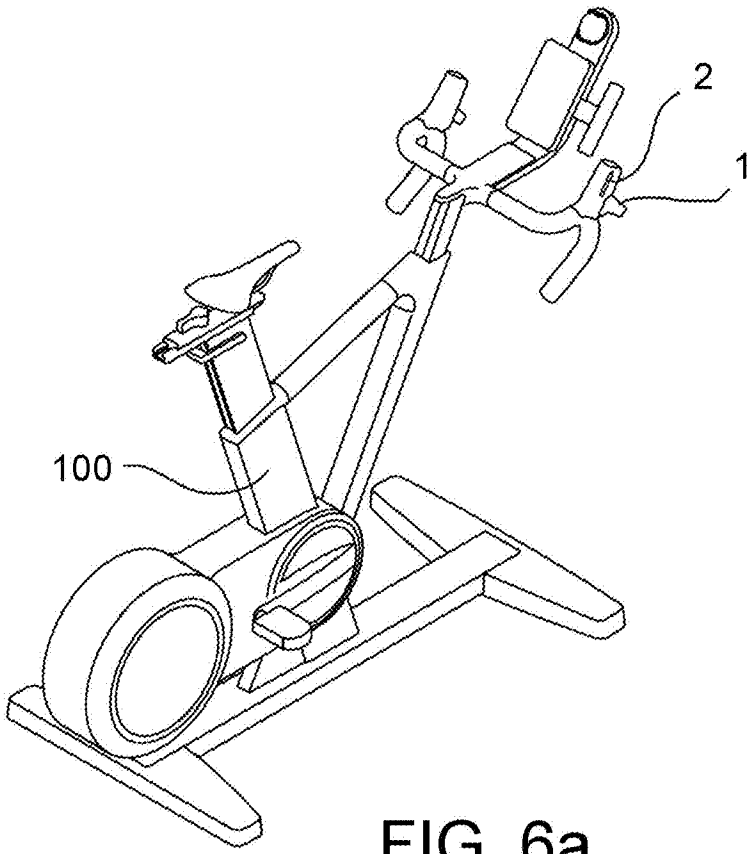
FIG. 6*a* shows a perspective view of an exercise machine according to an embodiment of the present invention.

The exercise machine 100 may be any machine which can be used by a user to perform physical activity, such as, for example, a bike or cyclette (FIGS. 4*a*, 5*a*, 6*a*), a treadmill (FIGS. 7*a* and 8*a*), a muscle development apparatus, and so on.

Figure 7B:
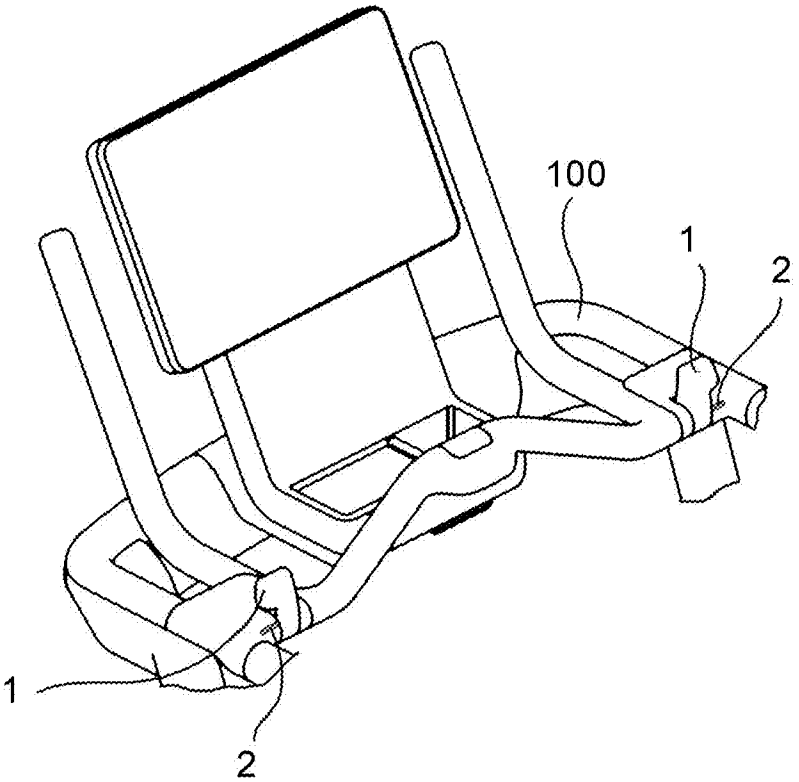
FIG. 7*b* shows an enlarged view of a portion of the exercise machine in FIG. 7*a;*
Figure 7A:
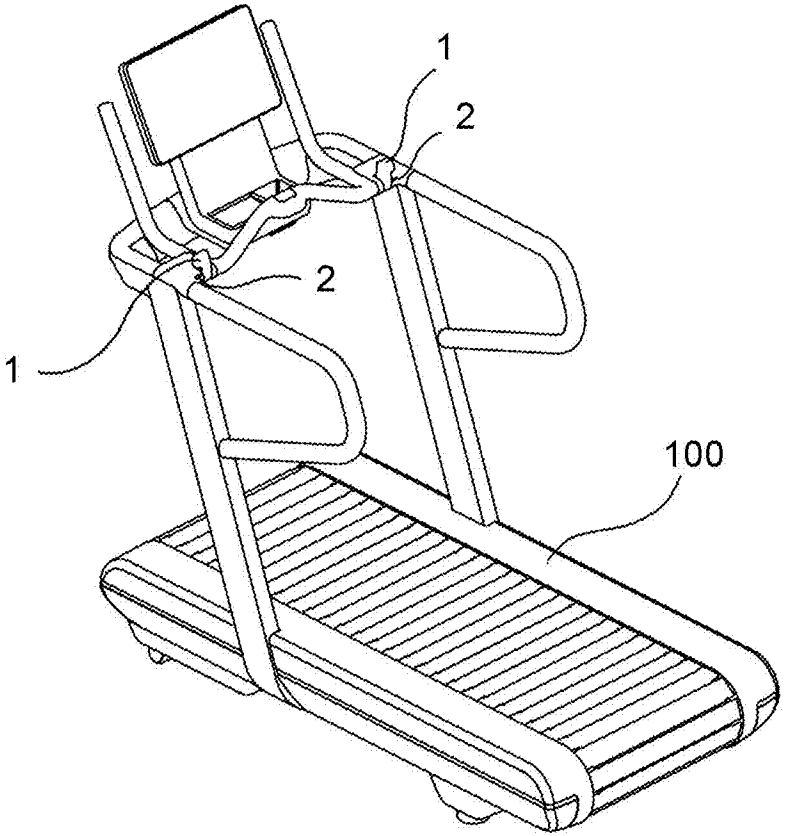
FIG. 7*a* shows a perspective view of an exercise machine according to an embodiment of the present invention.
Figure 8B:
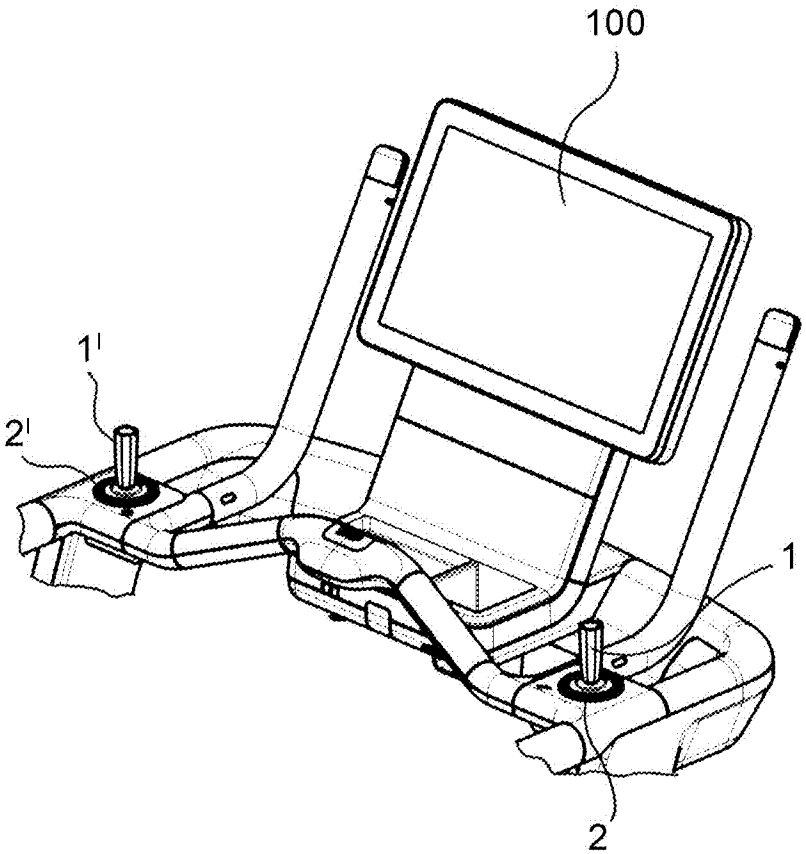
FIG. 8*b* shows an enlarged view of a portion of the exercise machine in FIG. 8*a;*
Figure 8A:
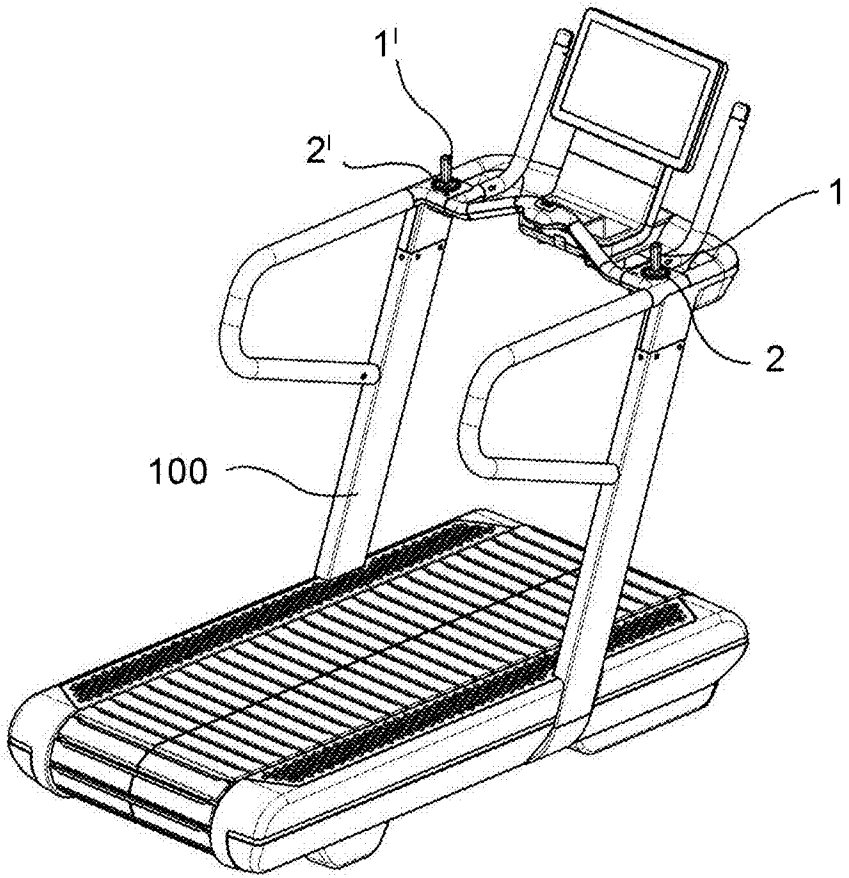
FIG. 8*a* shows a perspective view of an exercise machine according to an embodiment of the present invention.

The examples of exercise machines shown in the figures are bikes (FIGS. 4*a*, 5*a*, 6*a*) and treadmills (FIGS. 7*a* and 8*a*).

The exercise machine 100 comprises at least one control device 1 which can be actuated by the user to impart a command to the exercise machine 100.

For the purpose of the present invention, "control device" means any actuator which can be manually actuated by the user to impart a command to the exercise machine 100, such as, for example, a lever, a knob, a button, a cursor, a joystick, a touchscreen pad, and any other device of similar or equivalent actuation device.

The examples of said at least one control device 1 shown in the figures are buttons (FIGS. 4*a* and 4*b*), knobs (FIGS. 5*a* and 5*b*), levers (FIGS. 6*a*, 6*b* and FIGS. 7*a*, 7*b*) and joysticks (FIGS. 8*a* and 8*b*).

As described in further detail below, "imparting a command to the exercise machine 100", by means of the manual actuation, by the user, of said at least one control device 1, means the variation of a control parameter of the exercise machine 100.

Such a control parameter of the exercise machine 100 depends on the type of exercise machine 100.

"Control parameter of the exercise machine" means either a single control parameter, such as, for example, the forward speed of a treadmill or the pedaling resistance of a bike, or a level of workout difficulty whose choice involves the automatic setting of one or more previously set control parameters.

In greater detail, again by way of example, if the exercise machine 100 is a treadmill, such a control parameter may be the advancement speed of the treadmill, the gradient or slope of the running or walking surface of the treadmill, or the workout difficulty level, to which a set pair of advancement speed values of the treadmill and gradient or slope of the running or walking surface on the treadmill correspond. For example: difficulty level 1, walking on level ground (speed=5 km/h; slope=0%); difficulty level 2, jogging (speed=8 km/h; slope=2%) and so on.

If, on the other hand, the exercise machine 100 is a bike, such a control parameter may be the pedaling resistance, the transmission ratio, by varying which it is possible to increase or decrease the revolutions per minute of the pedals, for a given resistance, or the workout difficulty level to which a given pair of pedaling resistance and transmission ratio values correspond.

Turning back to the exercise machine 100 according to the present invention in general, it also comprises at least one lighting device 2.

Advantageously, the at least one lighting device 2 is positioned on the exercise machine 100 so as to identify said at least one control device 1 with which the exercise machine 100 is provided when the at least one lighting device 2 is lit.

Indeed, advantageously, the at least one lighting device 2 is in such a position that, when it is lit, it is possible for the user to easily and quickly locate the at least one control device 1, even if the exercise machine 100 is, for example, in a dark, poorly lit or deliberately dimly lit environment.

Furthermore, advantageously, the at least one lighting device 2 is in such a position that, when it is lit, it is possible for the user to locate the position of the at least one control device 1 very intuitively even if the user is highly focused on following a personal trainer or is simply tired, fatigued or under strain.

In addition, as described below with reference to some embodiments, the at least one lighting device 2 can be controlled by a data processing unit (also described below) with which the exercise machine 100 is equipped, so as to generate specific light sequences according to which it is possible to provide the user with information representative of a state and/or function of the exercise machine 100 during the physical activity and/or indications as to whether the at least one control device 1 is actuated or not.

With regard to the position of the at least one lighting device 2 with respect to the at least one control device 1, it is worth noting that the at least one lighting device 2 may be positioned in any position with respect to the at least one control device 1 adapted to allow, in case of lighting of the at least one lighting device 2, the unequivocal identification of the at least one control device 1 with which the at least one lighting device 2 is operatively associated.

According to an embodiment, shown for example in FIGS. 4*a*, 4*b*, 5*a*, 5*b*, the at least one lighting device 2 is positioned so that the respective light point is on the at least one control device 1.

According to a further embodiment, alternative to the previous one, shown for example in FIGS. 6*a*, 6*b*, 7*a*, 7*b*, the at least one lighting device 2 is positioned so that the respective light point is next to the at least one control device 1.

According to another alternative embodiment, shown, for example, in FIGS. 8*a* and 8*b* above, the at least one lighting device 2 is positioned so that the light point thereof surrounds a portion of the exercise machine on which the at least one control device 1 is present.

With reference now in general to FIGS. 1, 2, 3 and 9*a*, according to an embodiment, the at least one lighting device 2 comprises at least one light source 3 and at least one light diffuser 4.

The at least one light diffuser 4 is positioned on the exercise machine 100 so as to identify said at least one control device 1 when the at least one light diffuser 4 is lit.

With regard to the positioning of the at least one light diffuser 4 with respect to the at least one control device 1, the considerations given above with regard to the positioning in general between the at least one lighting device 2 and the at least one control device 1, in which, in the embodiments described above, the at least one light diffuser 4 of the at least one lighting device 2 was defined in general as a light point, apply and are therefore not repeated.

Figure 2:
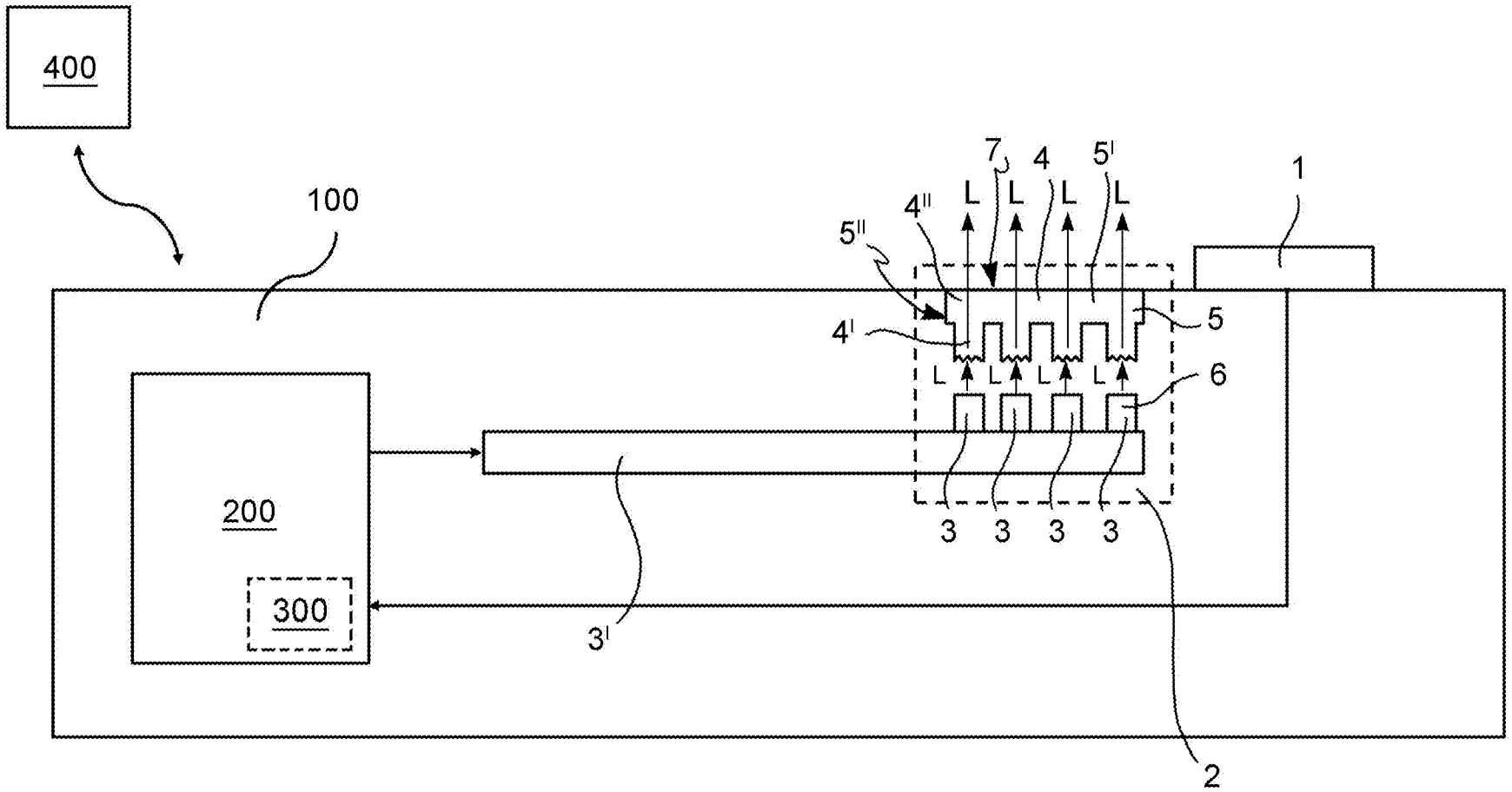
FIG. 2 shows, by means of a block chart, an exercise machine according to a further embodiment of the present invention.
Figure 3:
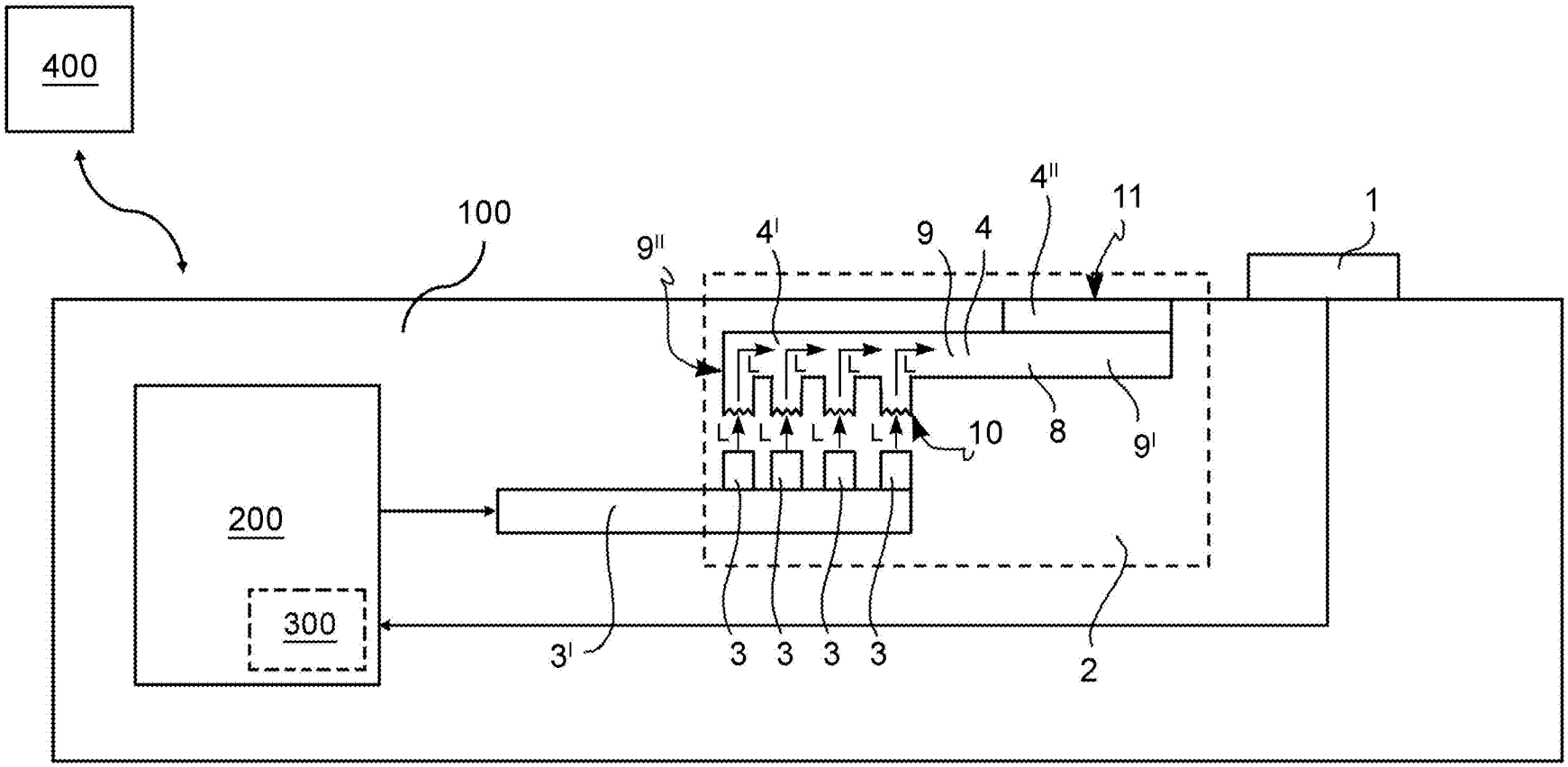
FIG. 3 shows, by means of a block chart, an exercise machine according to a further embodiment of the present invention.
Figure 9A:
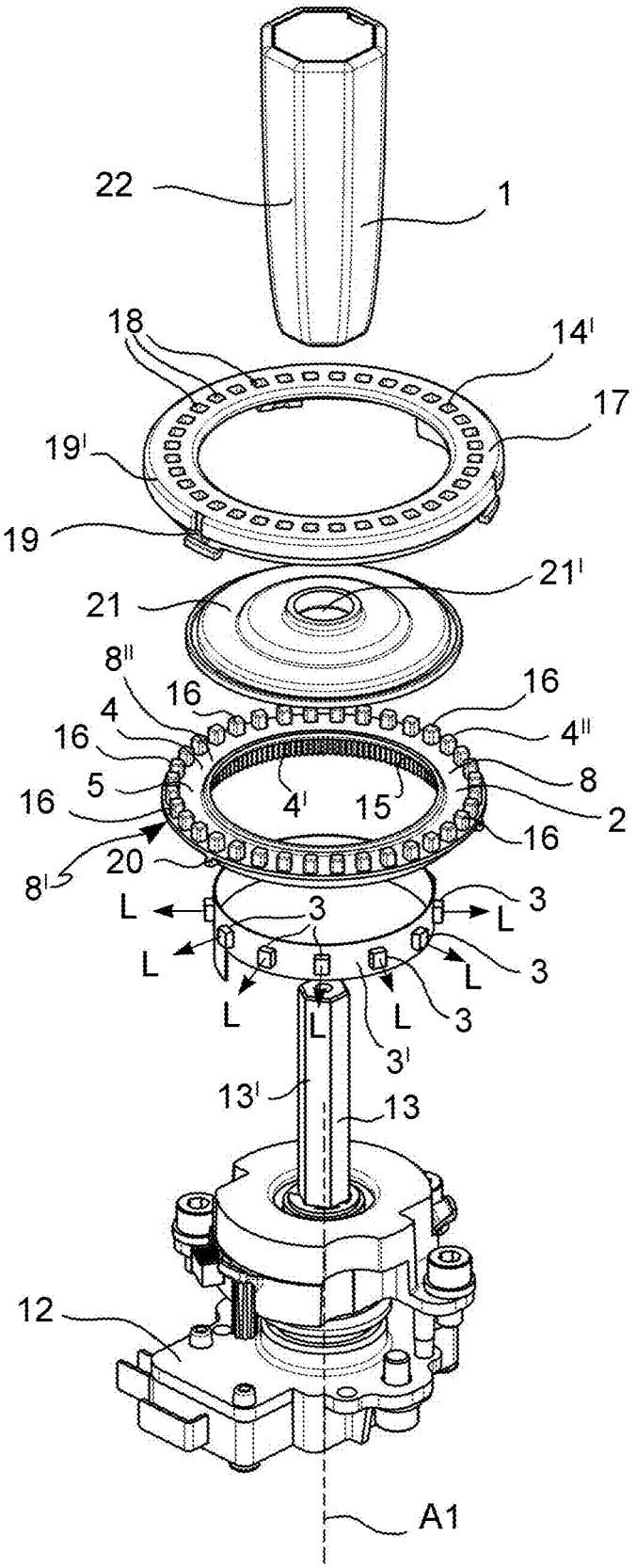
FIG. 9*a* shows an exploded perspective view of some components of an exercise machine according to an embodiment of the present invention.

With reference to FIGS. 2, 3 and 9*a*, according to an embodiment, the at least one light diffuser 4 comprises a first end 4' adapted to receive a light L (symbolically indicated in the figures by arrows) from said at least one light source 3 and a second end 4" adapted to diffuse the light L received from the first end 4'.

According to an embodiment, shown for example in FIG. 2, the first end 4' of the at least one light diffuser 4 and the second end 4" of said at least one light diffuser 4 are substantially coincident.

It is worth noting that in this embodiment, the at least one light diffuser 4, preferably made of transparent material (e.g. plastic), is adapted to perform a light conveying function.

In greater detail, the first end 4' of the at least one light diffuser 4 and the second end 4" of the at least one light diffuser 4 define a main body 5 having a first surface 6 facing the at least one light source 3 and shaped (e.g. preferably of a clear transparent material) to convey the light L received from the at least one light source 3.

In an embodiment, the first surface 6 of the main body, facing the at least one light source 3, in addition to being made of clear transparent material, may be shaped (e.g. preferably knurled, as shown diagrammatically in FIG. 2) to amplify the light L received from the at least one light source 3.

Furthermore, in the most general embodiment, such a main body 5 comprises a second surface 7 facing towards the outside of the exercise machine 100 and shaped to diffuse the light L outside of the exercise machine 100.

In this regard, the first surface 6, the second surface 7 and at least one first inner portion 5' of the main body 5 of the at least one light diffuser 4, extending from the first surface 6 to the second surface 7, are made of clear transparent material to allow the transmission of the light L received from the at least one light source 3 outside the exercise machine 100.

Furthermore, at least one second outer portion 5" of the main body 5 of the at least one light diffuser 4, extending about the first inner portion 5' of the main body 5 from the first surface 6 to the second surface 7, is made of opaque transparent material to reduce the dispersion of the light L during transmission inside the at least one light diffuser 3.

Figure 1:
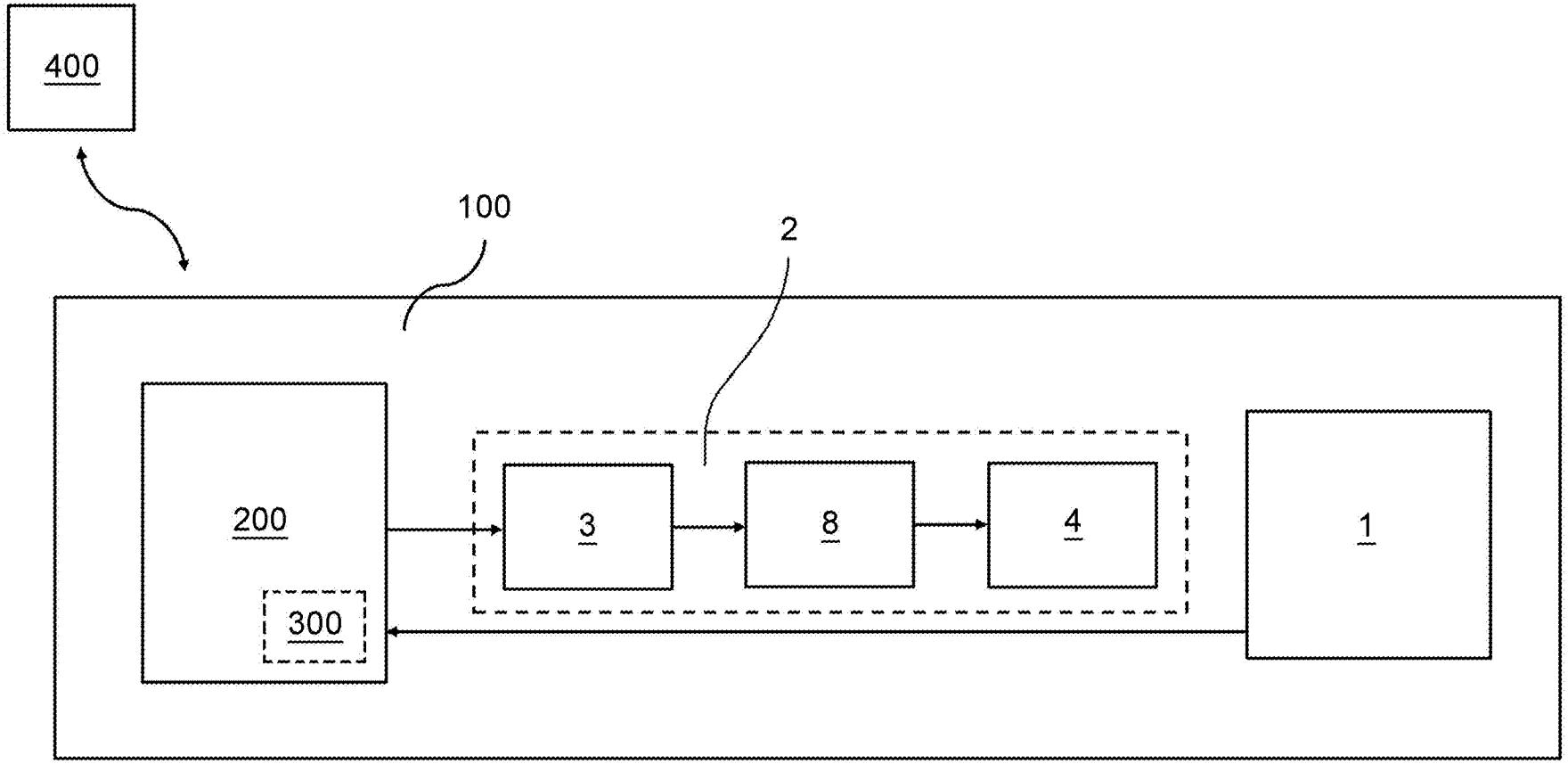
FIG. 1 shows, by means of a block chart, an exercise machine according to an embodiment of the present invention.

According to a further embodiment, alternative to the previous one, shown for example in FIG. 3 and diagrammatically also in FIG. 1, said at least one light diffuser 4 further comprises at least one light conveying element 8 arranged between the first end 4' of the at least one light diffuser 4 and the second end 4" of the at least one light diffuser 4.

The at least one light conveying element 8 is preferably made of transparent plastic.

In greater detail, the first end 4' of the at least one light diffuser 4, the second end 4" and the at least one light conveying element 8 of the at least one light diffuser 4 define a respective main body 9 having a first surface 10 facing the at least one light source 3 and shaped (e.g. preferably made of clear transparent material) to amplify the light L received from the at least one light source 3.

In an embodiment, the first surface 10, facing the at least one light source 3, in addition to being made of clear transparent material, can be shaped (e.g. preferably knurled, as diagrammatically shown in FIG. 3) to amplify the light L received from the at least one light source 3.

Furthermore, in the main embodiment, such a main body 9 comprises a second surface 11 facing towards the outside of the exercise machine 100 and shaped to diffuse the light L outside of the exercise machine 100.

In this regard, the first surface 10, the second surface 11 and at least one first inner portion 9' of the main body 9 of the at least one light diffuser 4, extending from the first surface 10 to the second surface 11, are made of clear transparent material to allow the transmission of the light L received from the at least one light source 3 outside the exercise machine 100.

Furthermore, at least one second outer portion 9" of the main body 9 of the at least one light diffuser 4, extending about the first inner portion 9' of the main body 9 from the first surface 10 to the second surface 11, is made of opaque transparent material to reduce the dispersion of light L during transmission inside the at least one light diffuser 4.

With reference to any of the previous embodiments, the at least one lighting device 2 comprises a plurality of light sources 3, e.g. a plurality of LEDs (from the acronym, Light Emitting Diode).

In more detail, as shown diagrammatically in FIGS. 2 and 3, the plurality of light sources 3 are distributed on a respective support 3' to form a strip.

The support 3' further comprises an electronic circuitry, not shown in the figures, to allow the plurality of light sources 3 to be connected electrically to an electrical supply, not shown in the figures, and to a data processing unit, described below, to control the operation of the plurality of light sources 3.

With reference now in particular to FIGS. 8*a*, 8*b*, 9*a*, 9*b*, 9*c* and 10-14, according to an embodiment, the at least one lighting device 2 is annular in shape so that the second end 4" of the at least one light diffuser 4 surrounds a portion of exercise machine 100 on which said at least one control device 1, e.g. a joystick (as shown in the above figures) is present.

In particular, as shown in FIG. 9*a*, the at least one control device 1 (joystick) comprises a base 12, which can be operatively fixed to a portion of the exercise machine 100 (not shown in the figure).

The base 12 has a respective longitudinal development axis A1.

Furthermore, the at least one control device 1 comprises a lever 13 operatively connected to the base 12.

The operative connection of the lever 13 to the base 12 is such that it can move the lever 13 in any operative direction of a plurality of operative directions VO (FIG. 9*b*), described below.

In greater detail, the lever 13 is operatively connected to the base 12 by means of an elastic element (e.g. a spring, not shown in the figures, fitted about the lever 13) which allows the lever 13 to maintain a vertical resting position, e.g. along a direction substantially parallel to the longitudinal development axis A1 of the base 12, and to be able to move the lever 13 in any operative direction of the plurality of operative directions VO.

Figure 9C:
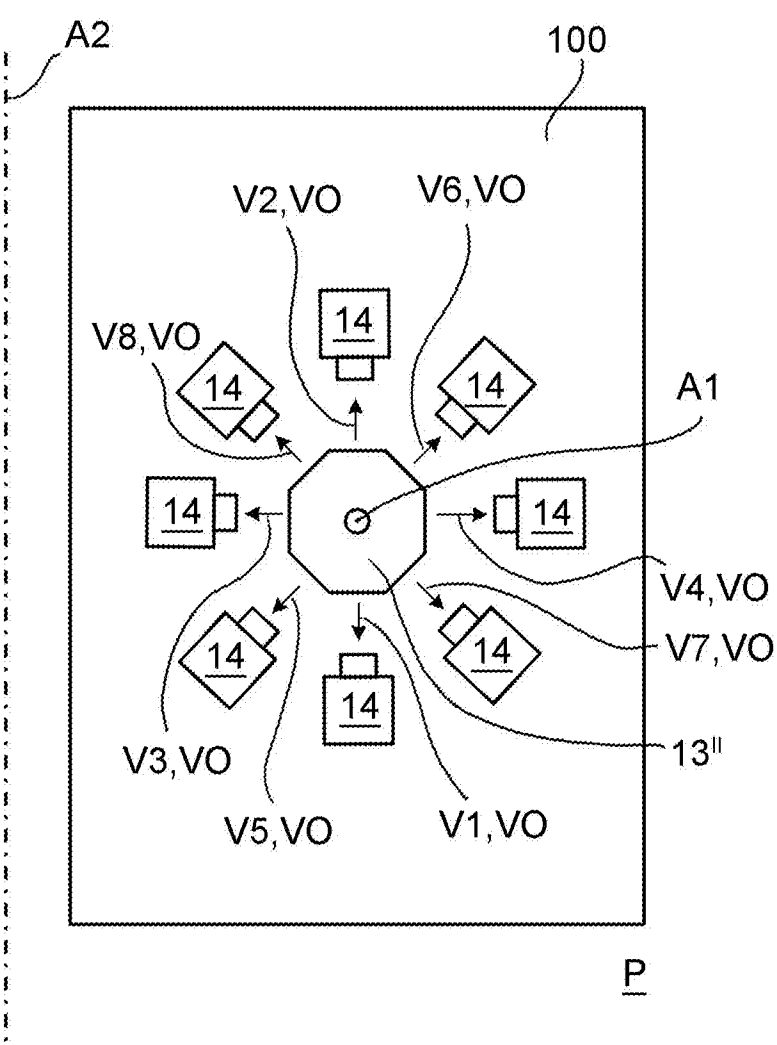
FIGS. 9*b* and 9*c* diagrammatically show a top view and a bottom view, respectively, of an assembled portion of some components in FIG. 9*a* to show an example of how a respective mechanism works.

When operatively connected to the base 12, the lever 13 comprises a first portion 13' (shown in FIGS. 9*a* and 9*b*) extending outside the base 12 and a second portion 13", shown only in FIG. 9*c*, extending inside the base 12.

Figure 9B:
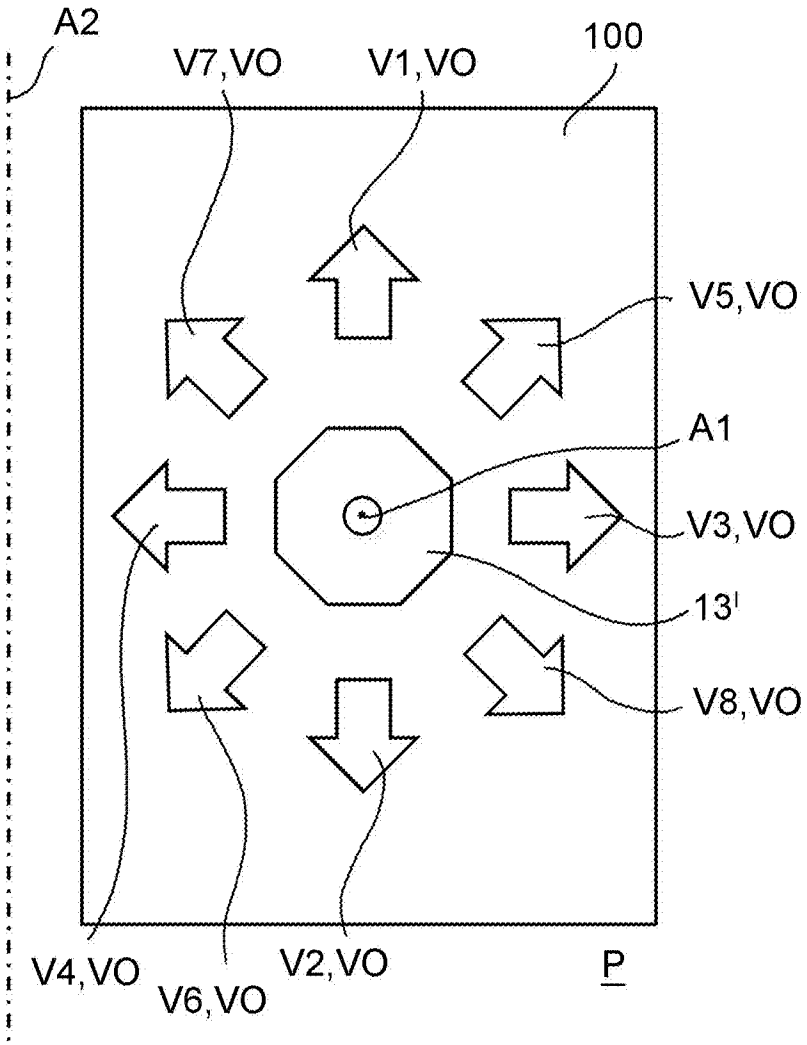

The operative connection of the lever 13 to the base 12 is such that it can move the first portion 13' of the lever 13 in any operative direction of the plurality of operative directions VO (FIG. 9*b*).

The movement of the first portion 13' of the lever 13 can be obtained by tilting the lever 13 with respect to a resting direction of the lever 13, coinciding with the longitudinal development axis A1 of the base 12.

The movement of the first portion 13' of the lever 13 in a first operative direction of the plurality of operative directions VO corresponds to the movement of the second portion 13" of the lever 13 in a second operative direction of the plurality of operative directions VO, opposite to the first operative direction.

With reference to FIG. 9*b*, which diagrammatically shows a top view of the at least one control device 1, the plurality of operating directions VO in which the first portion 13' of the lever 13 can be moved is distributed on a transverse reference plane P which is substantially orthogonal to the resting direction of the lever 13, coinciding with the longitudinal development axis A1 of the base 12.

FIG. 9*b* also diagrammatically shows a longitudinal development axis A2 of the portion of the exercise machine 100 in which the at least one control device 1 is fixed. The longitudinal development axis A2 of the portion of exercise machine 100 also lies on the reference plane P.

Turning back, in general, to the at least one control device 1, the base 12 further comprises a plurality of switches 14 (diagrammatically shown in FIG. 9*c*), e.g. microswitches, each of which faces the second portion 13" in a position such that it can be actuated from the second portion 13" of the lever 13 when it is moved in any one of the operative directions of the plurality of operative directions VO, described above.

Each switch of the multiple switches 14 can be operated to impart a corresponding command to the exercise machine 100.

It is worth noting that, as previously defined, the command to be imparted to the exercise machine 100 means the variation of a control parameter of the exercise machine 100, also previously defined with the support of some examples.

With particular reference to FIG. 9*c*, which diagrammatically shows a bottom view of the at least one control device 1, the plurality of operating directions VO in which the second portion 13' of the lever 13 can be moved is distributed over the transverse reference plane P which is substantially orthogonal to the resting direction of the lever 13, coinciding with the longitudinal development axis A1 of the base 12.

It is worth noting that each operative direction of the first portion 13' of the lever 13, represented by an arrow in FIG. 9*b*, corresponds to a first operative direction V1 of the second portion 13" of the lever 13, opposite to the first operative direction V1 of the first portion 13' of the lever 13, represented by an arrow facing in the opposite direction in FIG. 9*c*.

For example, a first operative direction V1 of the first portion 13' of the lever 13, represented by an arrow pointing upwards in FIG. 9*b*, corresponds to a first operative direction V1 of the second portion 13" of the lever 13, opposite to the first operative direction V1 of the first portion 13' of lever 13, represented by an arrow pointing downwards in FIG. 9*c*.

For example, a second operative direction V2 of the first portion 13' of the lever 13, represented by an arrow pointing downwards in FIG. 9*b*, corresponds to a second operative direction V2 of the second portion 13" of the lever 13, opposite to the second operative direction V2 of the first portion 13' of the lever 13, represented by an arrow pointing upwards in FIG. 9*c*.

For example, a third operative direction V3 of the first portion 13' of the lever 13, represented by an arrow pointing rightwards in FIG. 9*b*, corresponds to a third operative direction V3 of the second portion 13" of the lever 13, opposite to the third operative direction V3 of the first portion 13' of the lever 13, represented by an arrow pointing leftwards in FIG. 9*c*.

For example, a fourth operative direction V4 of the first portion 13' of the lever 13, represented by an arrow pointing leftwards in FIG. 9*b*, corresponds to a fourth operative direction V4 of the second portion 13" of the lever 13, opposite to the fourth operative direction V4 of the first portion 13' of the lever 13, represented by an arrow pointing rightwards in FIG. 9*c*.

For example, a fifth operative direction V5 of the first portion 13' of the lever 13, represented by an arrow pointing towards the upper right corner in FIG. 9*b*, corresponds to a fifth operative direction V5 of the second portion 13" of the lever 13, opposite to the fifth operative direction V5 of the first portion 13' of the lever 13, represented by an arrow pointing towards the lower left corner in FIG. 9*c*.

For example, a sixth operative direction V6 of the first portion 13' of the lever 13, represented by an arrow pointing towards the lower left corner in FIG. 9*b*, corresponds to a sixth operative direction V6 of the second portion 13" of the lever 13, opposite to the sixth operative direction V6 of the first portion 13' of the lever 13, represented by an arrow pointing towards the upper right corner in FIG. 9*c*.

For example, a seventh operative direction V7 of the first portion 13' of the lever 13, represented by an arrow pointing towards the upper left corner in FIG. 9*b*, corresponds to a seventh operative direction V7 of the second portion 13" of the lever 13, opposite to the seventh operative direction V7 of the first portion 13' of the lever 13, represented by an arrow pointing towards the lower right corner in FIG. 9*c*.

For example, an eighth operative direction V8 of the first portion 13' of the lever 13, represented by an arrow pointing towards the bottom right corner in FIG. 9*b*, corresponds to an eighth operative direction V8 of the second portion 13" of the lever 13, opposite to the eighth operative direction V8 of the first portion 13' of the lever 13, represented by an arrow pointing towards the top left corner in FIG. 9*c*.

The number of operative directions of the plurality of operative directions VO along which the first portion 13' of the lever 13 can be actuated and, consequently, the number of corresponding switches of the plurality of switches 14 which can be actuated by the second portion 13" depends on the number of commands which can be imparted to the exercise machine 100 by means of the at least one control device 1.

In an embodiment, two commands may be imparted, e.g. to increase and decrease a control parameter of the exercise machine 100 (in the case of a treadmill, the speed, gradient or level of difficulty).

In this embodiment, the at least one control device 1 is configured to allow:

the movement of the first end 13' of the lever 13 in a first operative direction of the plurality of operative directions VO, corresponding to the movement of the second end 13" of the lever 13 in an opposite operative direction, to activate a first switch of the plurality of microswitches 14 and impart a first command to the exercise machine 100 (e.g. to increase a control parameter of the exercise machine 100);

the movement of the first end 13' of the lever 13 in a second operative direction of the plurality of operative directions VO, corresponding to the movement of the second end 13" of the lever 13 in a reverse operative direction, to operate a second switch of the plurality of microswitches 14 and impart a second command to the exercise machine 100 (e.g. to decrease the same control parameter of the exercise machine 100).

Preferably, the first operative direction and the second operative direction belong to the same directrix. In this operative condition, the first switch and the second switch of the plurality of switches 14 also face each other along the same directrix.

With reference to FIG. 9*b*, the first and second operative directions can be, for example, the operative direction V1 (arrow pointing upwards) and operative direction V2 (arrow pointing downwards) or, according to another example, they can be operative operation V3 (arrow pointing rightwards) and operative direction V4 (arrow pointing leftwards), respectively.

Therefore, with reference to FIG. 9*c*, the first switch and the second switch of the plurality of switches 14 can be the switch at the bottom and the switch at the top, respectively, or, according to another example, they can be the switch on the left and the switch on the right, respectively.

In a further embodiment, the number of commands which can be imparted can be four, e.g. to increase and decrease a first control parameter of the exercise machine 100 (in the case of a treadmill, the speed) and to increase and decrease a second control parameter of the exercise machine 100 (in the case of a treadmill, the gradient).

In this embodiment, the at least one control device 1 is configured to allow:

the movement of the first end 13' of the lever 13 in a first operative direction of the plurality of operative directions VO, corresponding to the movement of the second end 13" of the lever 13 in an opposite operative direction, to actuate a first switch of the plurality of microswitches 14 and impart a first command to the exercise machine 100 (e.g. to increase a first control parameter of the exercise machine 100);

the movement of the first end 13' of the lever 13 in a second operative direction of the plurality of operative directions VO, corresponding to the movement of the second end 13" of the lever 13 in an opposite operative direction, to actuate a second switch of the plurality of microswitches 14 and impart a second command to the exercise machine 100 (e.g. to decrease the first control parameter of the exercise machine 100);

the movement of the first end 13' of the lever 13 in a third operative direction of the plurality of operative directions VO, corresponding to the movement of the second end 13" of the lever 13 in a reverse operative direction, to actuate a third switch of the plurality of microswitches 14 and impart a third command to the exercise machine 100 (e.g. to increase a second control parameter of the exercise machine 100);

the movement of the first end 13' of the lever 13 in a fourth operative direction of the plurality of operative directions VO, corresponding to the movement of the second end 13" of the lever 13 in an opposite operative direction, to actuate a fourth switch of the plurality of microswitches 14 and impart a fourth command to the exercise machine 100 (e.g. to decrease a first control parameter of the exercise machine 100).

Preferably:

the first operative direction and the second operative direction belong to the same directrix. In this operative condition, the first switch and the second switch of the plurality of switches 14 also face each other along the same directrix;

the third operative direction and the fourth operative direction belong to the same directrix. In this operative condition, the third switch and the fourth switches of the plurality of switches 14 also face each other along the same directrix.

Therefore, with reference to FIG. 9*b:* the first and second operative directions, for example, can be the operative direction V1 (arrow pointing upwards) and the operative direction V2 (arrow pointing downwards), respectively;

the third and fourth operative directions, according to another example, may be the operative direction V3 (arrow pointing rightwards) and the operative direction V4 (arrow pointing leftwards), respectively.

Correspondingly, with reference to FIG. 9*c:* the first and the second switch of the plurality of switches 14, for example, can be the switch at the bottom and the switch at the top, respectively;

the third and fourth switches of the plurality of series of switches 14 can be the switch on the left and the switch on the right, respectively.

Turning back to the embodiment in FIG. 9*a*, in general, the at least one lighting device 2 is operatively fixable about the base 12 of the at least one control device 1.

Figure 12:
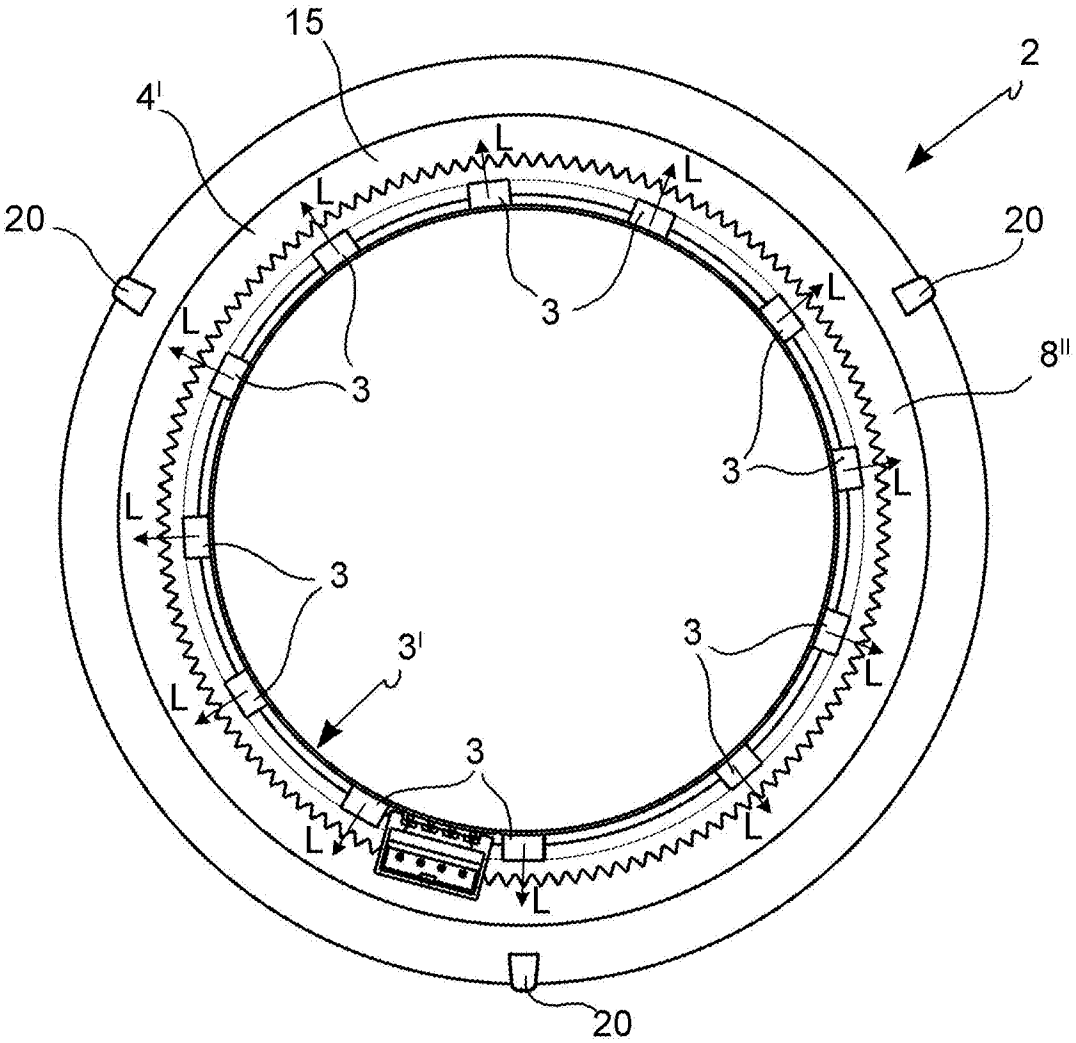
FIGS. 12, 13 and 14 show respective views of some components of the exploded view shown in FIG. 9*a*, assembled together.

According to this embodiment, the at least one lighting device 2 comprises a plurality of light sources 3, e.g. a plurality of LEDs (FIGS. 9*a* and 12).

In more detail, as shown in FIGS. 9*a* and 12, the plurality of light sources 3 are distributed on a respective annular support 3' (e.g. an annular strip) so that it can be fitted to the base 12 of the at least one control device 1.

In this embodiment, the support 3' of the plurality of light sources 3 can be fixed to the base 12 so that the plurality of light sources 3 faces outwards from the base 12 and that a respective light L (indicated by arrows in the figures) can be emitted by each light source of the plurality of light sources 3 towards the outside of the base 12 along a substantially transverse direction with respect to the longitudinal development axis A1 of the base 12.

The support 3' further comprises an electronic circuitry, not shown in the figures, to allow the plurality of light sources 3 to be connected electrically to an electrical supply, not shown in the figures, and to a data processing unit, described below, to control the operation of the plurality of light sources 3.

With reference in particular to FIGS. 11-14, also in this embodiment, the at least one light diffuser 4 comprises a first end 4' adapted to receive a light L from said at least one light source 3 and a second end 4" adapted to diffuse the light L received from the first end 4'.

Furthermore, in this embodiment, the at least one light diffuser 4 further comprises at least one light conveying element 8 arranged between the first end 4' of the at least one light diffuser 4 and the second end 4" of the at least one light diffuser 4.

In this embodiment, the at least one light conveying element 8 is annular in shape.

The at least one light conveying element 8 comprises a first surface 8' which, when the at least one lighting device 2 is operatively fixed to the base 12, faces towards the base 12 of the at least one control device 1.

The at least one light conveying element 8 further comprises a respective second surface 8' which, when the at least one lighting device 2 is operatively fixed to the base 12, faces towards the opposite side with respect to the one on which the base 12 is located.

In this embodiment, the first end 4' of the at least one light diffuser 4 comprises an annular wall 15 which, when the at least one lighting device 2 is operatively fixed to the base 12, extends parallel to the longitudinal extension axis A1 and faces the plurality of light sources 3 with which the at least one lighting device 2 is provided.

In more detail, the annular wall 15 has a shaped surface (e.g. preferably made of clear transparent material) to convey the light L received from the plurality of light sources 3.

In an embodiment, the annular wall surface 15, in addition to being manufactured in clear transparent material, may be shaped (e.g. preferably knurled, as diagrammatically shown in the figures) to amplify the light L received from the at least one light source 3.

In the more general embodiment, the second end 4" of the at least one light diffuser 4 comprises a plurality of light diffusers 16, e.g. each shaped as a parallelepiped, distributed along a circumference and extending orthogonally with respect to the second surface 8" of the at least one light conveying element 8.

The annular wall 15 and the plurality of light diffusers 16 are made of clear transparent material to allow the transmission of the light L received from the plurality of light sources 3 to the outside of the exercise machine 100.

The at least one light conveying element 8 comprises at least one portion made of clear transparent material and one or more parts made of opaque transparent material to convey the light L transmitted by the annular wall 15 to the plurality of diffusers 16, thereby reducing the dispersion of the light L inside the at least one light diffuser 4.

Figure 13:
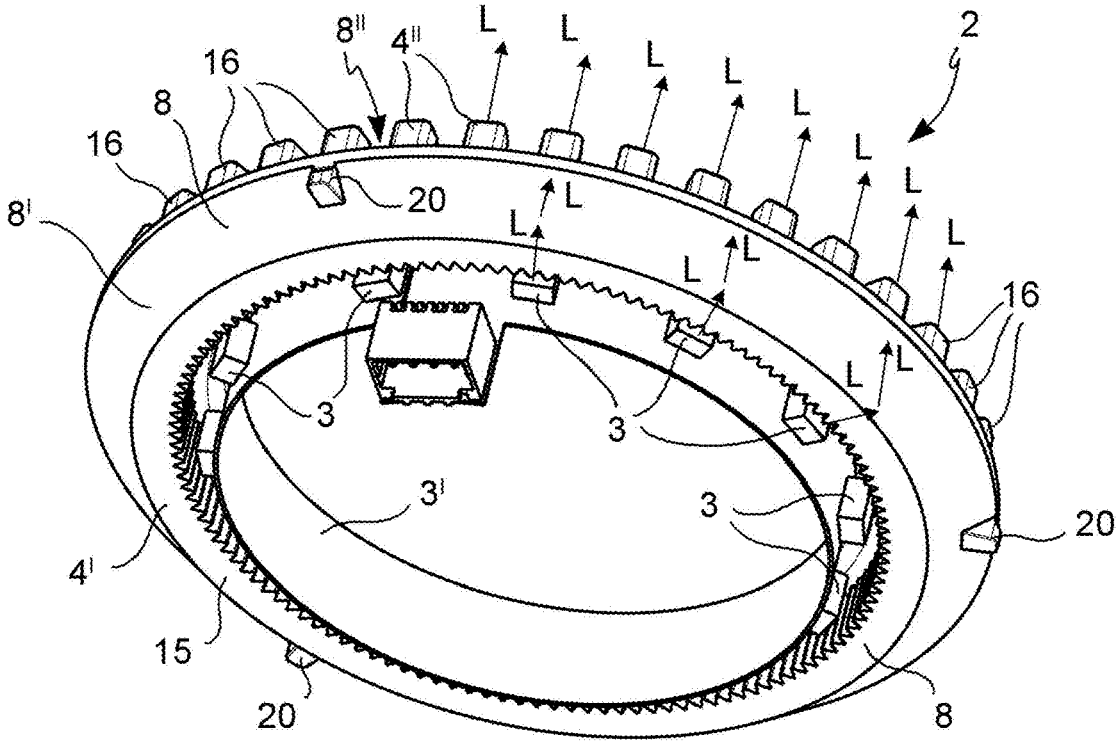
Figure 14:
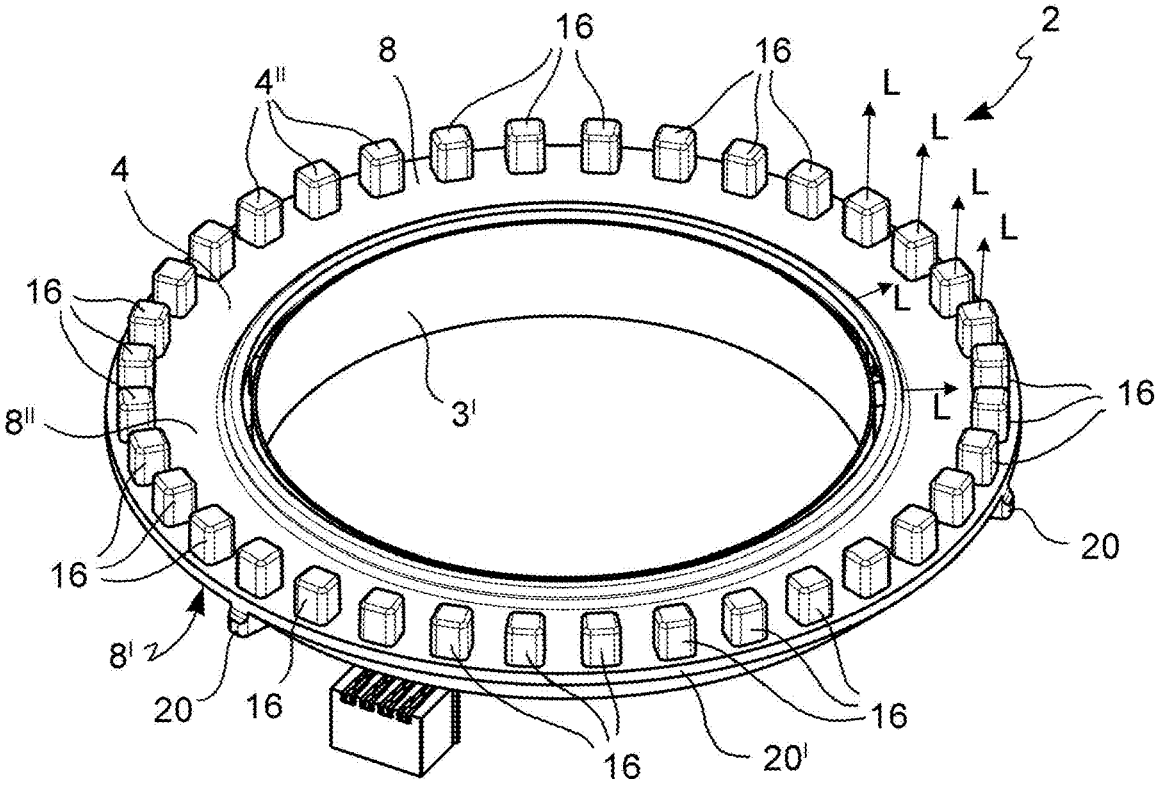

For example, for the purposes of FIGS. 13 and 14, the at least one portion of clear transparent material is, for example, the bottom and the inner part of the at least one conveying element 8, while the one or more parts of transparent opaque material are, for example, the outer part of the at least one conveying element 8.

In this manner, the light L emitted by the plurality of light sources 3 received by the annular wall 15 is conveyed by the at least one light conveying element 8 up to the plurality of light diffusers 16 from which it will be emitted in a direction substantially orthogonal (i.e. upwards) with respect to the at least one lighting device 2.

An example of a light pattern L is shown, where possible, with arrows also in FIGS. 13 and 14.

Figure 10:
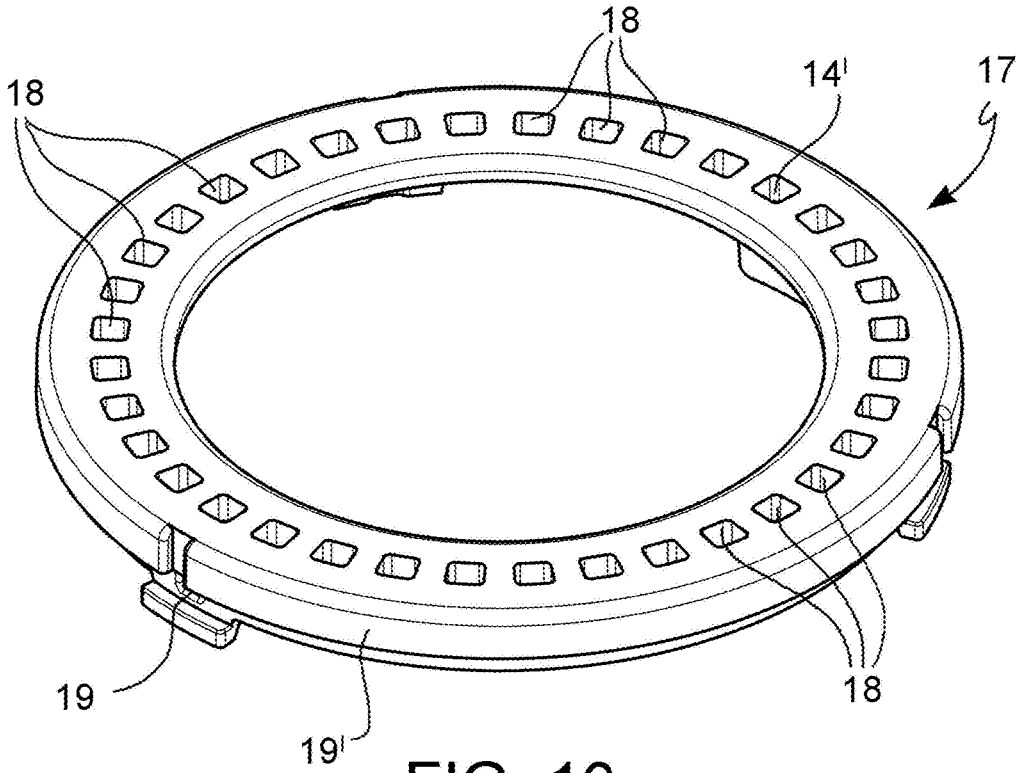
FIGS. 10, 11 show perspective views of components of the exploded view shown in FIG. 9*a;*

In the embodiment shown in FIGS. 9*a* and 10, the at least one control device 1 further comprises an annular covering element 17 of the at least one lighting device 2, which can be operatively fixed to the at least one light diffuser 4.

The covering element 17 comprises at least one through opening 14' to allow the insertion of the second end 4" of the at least one light diffuser 4.

In an embodiment, shown in FIGS. 9*a* and 10, the covering element 17 comprises a plurality of through openings 18 each for the insertion of a respective light diffuser of the plurality of light diffusers 16 with which the at least one light diffuser 4 is equipped.

It is worth noting that the covering element 17 further comprises a number of through-holes 19 (partially visible in FIGS. 9*a* and 10) distributed over an outer circumference 19' of the covering element 17.

Figure 11:
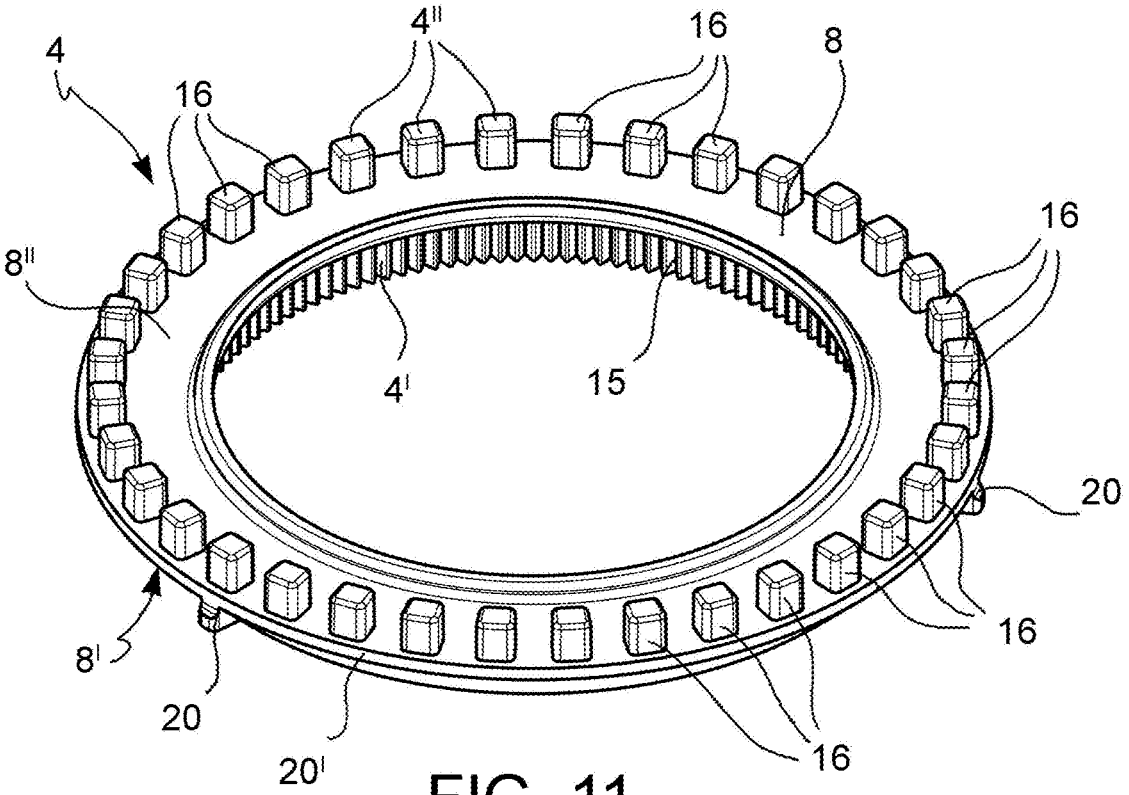

Each through-hole of the plurality of through-holes 19 of the covering element 17 is adapted to couple by snapping with a respective tooth of a plurality of teeth 20 distributed on a respective outer circumference 20' of the at least one diffuser 4 (e.g. see FIG. 11).

According to an embodiment, shown in FIG. 9*a*, the at least one control device 1 further comprises a protective element 21 provided in the middle with a corresponding through-hole 21' adapted to allow the insertion of the lever 13.

The protective element 21, preferably made of flexible plastic material, is adapted to be placed and withheld between the at least one light diffuser 4 and the covering element 17 when the covering element 17 is fixed to the at least one light diffuser 17.

As mentioned above, the fixing can be achieved by means of the snap-on coupling of each tooth of the plurality of teeth 20 with which the at least one light diffuser 4 is equipped and the respective through-hole of the plurality of through-holes 19 with which the covering element 17 is equipped.

The protective element 21 advantageously allows preventing external elements, such as dust, water or dirt, from falling into the at least one control device 1, in particular into the base 12 to which the lever 13 is operatively attached.

According to an embodiment, shown in FIG. 9*a*, the at least one control device 1 further comprises a grip 22 which can be fitted on the lever 13, preferably on the first portion 13' of the lever 13.

According to an embodiment, shown for example in FIGS. 1-3, in combination with any of those described above, the exercise machine 100 comprises a data processing unit 200, e.g. a microcontroller or a microprocessor, operatively connected to said at least one lighting device 2 and said at least one control device 1 of the exercise machine 100.

Furthermore, the exercise machine 2 comprises a memory unit 300 operatively connected to the data processing unit 200. The memory unit 300 can be either internal or external (as diagrammatically shown by a dashed line in the FIGS. 1-3, for example) to the data processing unit 200.

The data processing unit 200, by loading and executing one or more program codes, stored in the memory unit 300, is configured to control said at least one lighting device 2 on the basis of the variation of a control parameter of the exercise machine 100.

The control parameter of the exercise machine 100 can be controlled by the user by actuating said at least one control device 1 which can be identified by said at least one lighting device 2.

In greater detail, the actuation of the at least one control device 1 generates an electrical pulse representative of a discrete increase of the control parameter of the exercise machine.

The discrete increase of the control parameter may be equal to a single discrete unit if the at least one control device 1 is released immediately after actuation to return to the rest position, or the discrete increase may be equal to more than one discrete unit if the at least one control device 1, once actuated, is held in the actuation position for a specified period of time before being released to return to the rest position.

For example, if the control parameter is the speed of a treadmill, the discrete unit is 0.1 km/h, if the control parameter is the slope of the treadmill, the discrete unit is 0.5%.

If the control parameter is the workout difficulty level, the discrete unit is the change from a current (previously set) level to the next one, increasing or decreasing.

Therefore, the electrical pulse generates a command which depends on the control parameter set in the workout program that the user is performing.

In a "standard" operation, the control parameter of the exercise machine 100 (treadmill) can be the speed or slope, while, in the "level" workout program, the modifiable control parameter can be the workout difficulty level.

The data processing unit 200 is configured to receive this electrical pulse and, on the basis of such an electrical pulse, to provide a command corresponding to the variation of the control parameter required to the exercise machine 100.

If the exercise machine 100 is a treadmill and the control parameter variable by actuating the at least one control device 1 is the speed of the treadmill, after having received the pulse from the at least one control device 1, the data processing unit 200 is configured to provide a command represented by the variation (increase or decrease) of the speed of the treadmill to a driver of the treadmill, which will control an electrical motor of the treadmill in order to vary accordingly (increase or decrease) the speed of the treadmill.

According to an embodiment, in combination with any one of the embodiments described above in which the data processing unit 200 is present, the data processing unit 200 is configured to make the at least one light source 3 of said at least one lighting device 2 blink, until, during the user's workout on the exercise machine 100, the control parameter of the exercise machine 100 reaches a set reference value of said control parameter.

"Set reference value of said control parameter" mean both a reference value set at the beginning of the workout, which can be reached starting from a zero value, and a reference value set later (e.g. set by the user with the actuation of the at least one control device 1 or with the interaction with a graphic interface or display with which with the exercise machine 100 is equipped or automatically set by the workout program stored in memory unit 300) with the workout in progress, which can be reached starting from a previously set reference value, preferably not zero.

In this manner, the exercise machine 100 can show the transitional period during which the reference value of this control parameter has not yet been reached to the user during the workout.

According to a further embodiment, in combination with any one of the those described above in which the data processing unit 200 is present, the data processing unit 200 is configured to make the at least one light source of said at least one lighting device 2 blink at a set first frequency during the user's workout on the exercise machine 100, until a set first workout time instant is reached at which a variation of said control parameter of the exercise machine is envisaged.

Furthermore, in this embodiment, the data processing unit 200 is configured, starting from said set first time instant, to make the at least one light source 3 of said at least one lighting device 2 blink at a set second frequency, higher than the set first frequency, until, during the user's workout on the exercise machine 100, the control parameter of the exercise machine reaches a set reference value of said control parameter.

The "set reference value of said control parameter" was defined above.

In this manner, the exercise machine 100 can show the imminent change of the control parameter of the exercise machine 100 (blinking at the set first frequency) to the user and, subsequently, it can show the transitional period in which the reference value of said newly changed control parameter has not yet been reached (blinking at the set second frequency until the reference value is reached) to the user during the workout.

According to a further embodiment, in combination with any of those described above in which the data processing unit 200 is present, the data processing unit 200 is operatively connected to an additional data processing unit 400, remote with respect to the exercise machine 100, diagrammatically shown in FIGS. 1-3.

The further data processing unit 400 is, for example, a computer with which a personal trainer can be equipped during the classroom workout with several users, each equipped with an exercise machine in accordance with this invention.

The further data processing unit 400 is operatively connected to the data processing unit 200 via a data communication network, e.g. the Internet, in wired or wireless mode.

In this embodiment, the data processing unit 200 is configured, if it receives a respective command from the further data processing unit 400, to make the at least one light source 3 of said at least one lighting device 2 blink, during the user's workout on the exercise machine 100, to provide an alert to the user representative of the need to modify said control parameter of the exercise machine 100 by actuating said at least one control device 1 which can be identified by said at least one lighting device 2.

In this manner, each exercise machine 100 of a workout class can signal to the respective user with a light alert the moment in which changing the control parameter of the exercise machine 100, as requested by the personal trainer.

According to a further embodiment, in combination with any one of those described above in which the data processing unit 200 is present, the data processing unit 200 is configured to detect at least one parameter representative of the user's workout on the exercise machine 100.

For the purposes of this invention, "at least one parameter representative of the user's workout on the exercise machine" means any user parameter (either biometric or workout) which can be monitored by the exercise machine 100 during the workout, such as, for example, if the exercise machine 100 is a treadmill, heart rate, pace rate while running, workout time, distance covered, and so on.

In this embodiment, the data processing unit 200 is configured, if said at least one parameter representative of the current workout by the user on the exercise machine 100 has reached a respective reference threshold value, to make the at least one light source 3 of said at least one lighting device 2, blink during the user's workout on the exercise machine 100, to provide an alert to the user which is representative of the need to change said control parameter of the exercise machine 100 by actuating said at least one control device 1 identified by said at least one lighting device 2.

In this manner, the exercise machine 100 can signal to the user, by means of a light alert during the course of the workout, the need to modify this control parameter of the exercise machine 100 by actuating of said at least one control device 1, at which point said at least one lighting device 2 is placed.

For example, if the exercise machine 100 is a treadmill, it may be indicated to the user by a light alert to inform the user to decrease the workout speed or slope when the user's heart rate has reached a reference value.

With reference to the embodiment of FIGS. 8*a*, 8*b*, 9*a* and those described above in which the data processing unit 200 is present, an example of operation of the exercise machine 100 is now described.

The exercise machine 100 is equipped with a first control device 1, with which a first lighting device 2 is operatively associated, and a second control device 1', with which a second lighting device 2' is operatively associated.

The first control device 1 and the second control device 1' are the same (joystick) with the difference that the first control device 1 and the second control device 1' are adapted to vary different control parameters of the exercise machine 100.

If the exercise machine 100 is a treadmill (as shown in FIG. 8*a*), the first control parameter variable with the first control device 1 is the speed of the treadmill, while the second control parameter variable with the second control device 1' is the slope or gradient of the treadmill.

The first lighting device 2, annular in shape, surrounds the portion of the treadmill in which the first control device 1 is fixed.

The second lighting device 2', which is the same as the first lighting device 2, surrounds the portion of the treadmill in which the second control device 1' is fixed.

The first lighting device 2 and the second lighting device 2' are mutually independent.

Indeed, the data processing unit 200 is configured to make the plurality of light sources 3 of the first lighting device 2 blink and to keep the plurality of light sources 3 of the second lighting device 2' fixed (on or off).

As mentioned above, the data processing unit 200 is configured to control the plurality of light sources 3 of the first lighting device 2 and the plurality of light sources 3 of the second lighting device 2'.

When the exercise machine 100, and thus also the data processing unit 200, is in standby mode, the plurality of light sources 3 (LED) of the first lighting device 2 and the plurality of light sources 3 (LED) of the second lighting device 2' are off.

After the actuation of the physical exercise surface (belt) of the treadmill, the plurality of light sources 3 of the first lighting device 2 blink until the speed of the treadmill reaches a set reference value.

The "set reference value of said control parameter" was defined above.

Once the set reference value is reached, the plurality of light sources 3 of the first lighting device 2 become fixed, indicating that the treadmill is moving at a constant speed corresponding to the set reference value.

The plurality of light sources 3 of the second lighting device 2 are fixed, indicating that the slope of the treadmill is constant at a respective set reference value.

After actuating the first control device 1 to take the speed of the treadmill to an additional set reference value higher than the previous one (speed increase), the plurality of light sources 3 of the first lighting device 2 blink until the speed of the treadmill has reached the additional set reference value, i.e. the last set reference value.

Once the further set reference value is reached, the plurality of light sources 3 of the first lighting device 2 become fixed, indicating that the treadmill is moving at a constant speed corresponding to the further set reference value, i.e. the last one.

In more detail, following the activation of the first control device 1 to take the speed of the treadmill to an additional reference value higher than the previous one (speed increase), a switch of the plurality of switches 14 of the first lighting device 2 is contacted by the second end 13" of the lever 13 (joystick).

The contact of this switch generates an electrical pulse which is representative of a discreet increase in the speed of the treadmill.

As mentioned above, the discrete increase may be equal to a single discrete unit if the first control device is released immediately after actuation to return to the rest position, or the discrete increase may be equal to more than one discrete unit if the first control device, once actuated, is held in the actuation position for a specified period of time before being released to return to the rest position.

For example, if the control parameter is the speed, the discrete unit is 0.1 km/h, if the control parameter is the slope, the discrete unit is 0.5%.

If the control parameter is the workout difficulty level, the discrete unit is the change from a current (previously set) level to the next one, increasing or decreasing.

Therefore, the electrical pulse generates a command which depends on the control parameter set in the workout program that the user is performing.

In a "standard" operation, the control parameter of the exercise machine 100 (treadmill) is the speed or slope, while, in the "level" workout program, the modifiable control parameter can be the workout difficulty level.

Turning back to the description of the example of operation, once such an electrical pulse has been received, the data processing unit 200 of the treadmill, on the basis of such an electrical pulse, provides a speed increase command to the driver of the treadmill, which consequently controls the electric motor of the treadmill.

The driver communicates the instantaneous speed value to the data processing unit 200, which compares the instantaneous speed value with a set speed reference value, which is the sum of the set speed value at the time of the request for the speed increase and the required speed increase.

Once the further set reference value has been reached, the data processing unit 200 interrupts the blinking of the plurality of light sources 3 of the first lighting device 2 to keep them fixedly on, indicating that the treadmill is moving again at a constant speed, corresponding to the last set reference speed value.

These considerations apply also if the command is to reduce the speed.

After actuating the second control device 1' to take the slope of the treadmill to a set reference value higher than the previous one (slope increase), the plurality of light sources 3 of the second lighting device 2' blink until the slope of the treadmill has reached the set reference value.

Once the respective set reference value is reached, the plurality of light sources 3 of the first lighting device 2' become fixed, indicating that the treadmill is moving at a constant slope corresponding to the last set slope reference value.

In greater detail, following the actuation of the second control device 1' to take the slope of the treadmill to an additional set reference value greater than the previous one (increase in slope), a switch of the plurality of switches 14 of the second lighting device 2' is contacted by the second end 13" of the lever 13 (joystick).

The contact of this switch generates an electrical pulse representative of a discreet increase in the slope of the treadmill.

The data processing unit 200 of the treadmill receives such an electrical pulse and, on the basis of such an electric impulse, provides the driver of the treadmill with a command to increase the slope of the treadmill, which controls the increase of the slope of the treadmill accordingly.

The driver communicates the instantaneous slope value to the data processing unit 200, which compares the instantaneous slope value with a set slope reference value, which is the sum of the set slope value at the time of the request for the slope increase and the required slope increase.

Once the further set reference value has been reached, data processing unit 200 interrupts the blinking of the plurality of light sources 3 of the second lighting device 2 to keep them fixedly on, indicating that the treadmill is moving again at a constant slope, corresponding to the last set reference slope value.

These considerations apply also if the command is to reduce the slope.

It is worth noting that the command to change the control parameter 1, as an alternative to the respective control device 1, can be imparted by means of interaction, by the user, with an interface or touchscreen display with which the exercise machine 100 can be equipped.

If the treadmill goes to pause or end of workout condition, following a command provided by the user via the interface or touchscreen display or by a command imparted by a personal trainer by means of the additional remote data processing unit 400, the plurality of light sources 3 of the first lighting device 2 blink until the treadmill stops.

Once the treadmill is stationary, the plurality of light sources 3 of the first lighting device 2 switch off.

Figure 15:
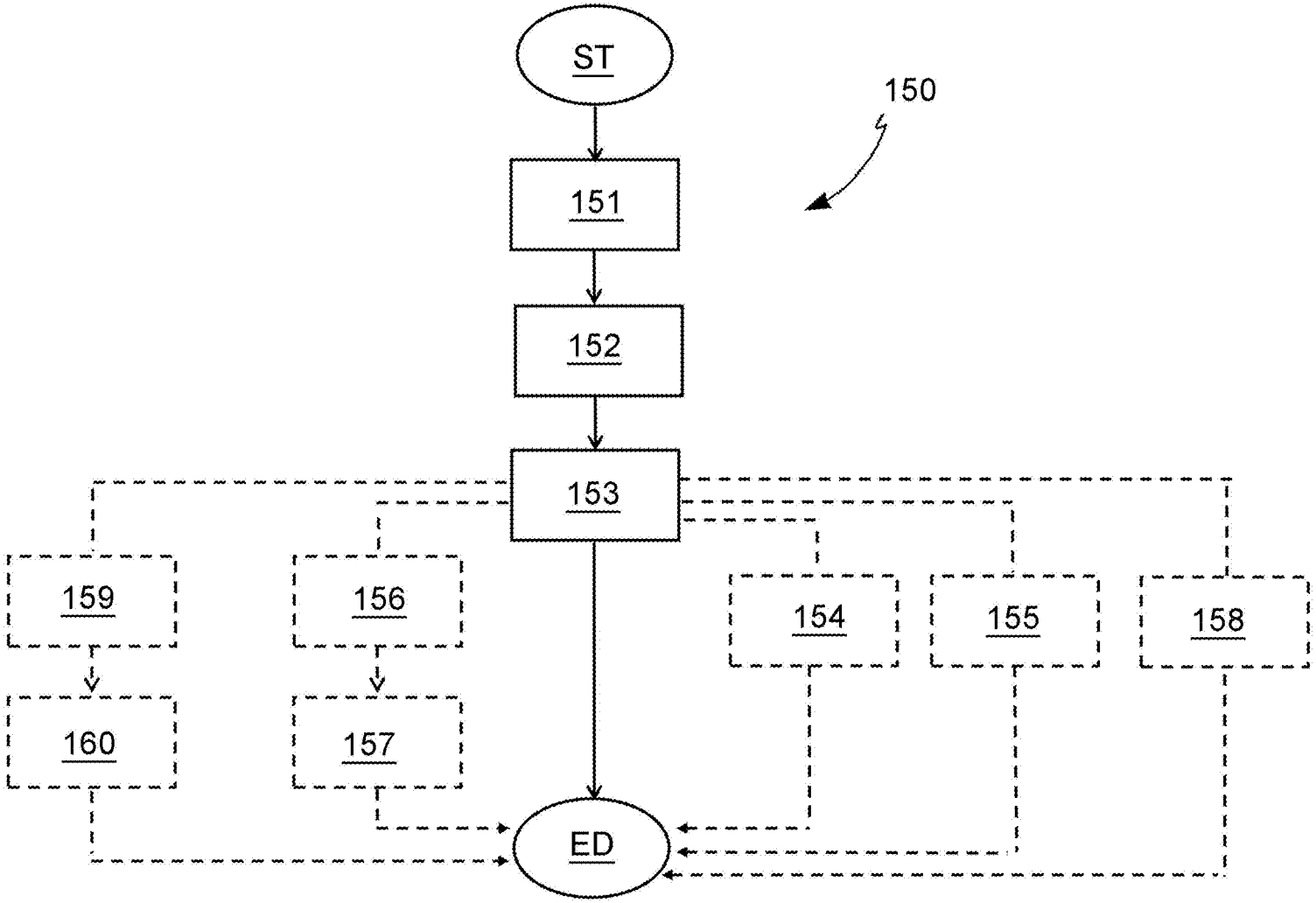
FIG. 15 shows, by means of a block chart, a method for identifying on an exercise machine one or more control devices of the exercise machine according to an embodiment of the present invention.

With reference now to FIG. 15, a method 150 of identifying on an exercise machine 100 one or more control devices 1 of the exercise machine is now described.

The method 150 comprises a symbolic step of starting ST.

The method 150 comprises a step of providing 151 at least one control device 1 which can be actuated by a user to impart a command to the exercise machine 100.

Examples of exercise machine 100 were described above.

The at least one control device 1 was described above according to different embodiments.

The method 150 further comprises a step of providing 152 at least one lighting device 2 positioned on the exercise machine 100.

The at least one lighting device 2 was described above according to different embodiments.

The method 150 further comprises a step of identifying 153, by said at least one lighting device 2, when said at least one lighting device 2 is illuminated, said at least one control device 1 with which the exercise machine 100 is provided.

The method 150 ends with a symbolic step of ending ED.

According to an embodiment, shown by dashed lines in FIG. 15, the method 150 comprises a step of checking 154, by a data processing unit 200 with which the exercise machine 100 is provided, said at least one lighting device 2 on the basis of the variation of a control parameter of the exercise machine 100.

According to an embodiment, in combination with the preceding one, the method 150 further comprises a step of blinking 155, by the data processing unit 200, at least one light source 3 of said at least one lighting device 2, until, during the user's workout on the exercise machine 100, the control parameter of the exercise machine 100 reaches a set reference value of said control parameter.

The "set reference value of said control parameter" was defined above.

According to a further embodiment, in combination with any one of those described above, shown by dashed lines in FIG. 15, the method 150 comprises the steps of:

blinking 156, by the data processing unit 200, the at least one light source 3 of said at least one lighting device 2 at a set first frequency during the user's workout on the exercise machine 100, until a set first workout time instant is reached at which a variation of said control parameter of the exercise machine 100 is envisaged;

from said set first time instant, blinking 157, by the data processing unit 200, the at least one light source 3 of said at least one lighting device 2 at a set second frequency, higher than the set first frequency, until, during the user's workout on the exercise machine 100, the control parameter of the exercise machine reaches a set reference value of said control parameter.

The "set reference value of said control parameter" was defined above.

According to a further embodiment, in combination with any one of those described above, shown by dashed lines in FIG. 15, the method 150 further comprises a step of blinking 158, by the data processing unit 200, the at least one light source 3 of said at least one lighting device 2, during the workout of the user on the exercise machine 100 if it receives a respective command from a further data processing unit 400, remote with respect to the exercise machine 100, to provide an alert to the user representative of the need to modify said control parameter of the exercise machine 100 by actuating said at least one control device 1 with which the at least one lighting device 2 was operatively associated.

According to a further embodiment, in combination with any one of those previously described, shown by dashed lines in FIG. 15, the method 150 further comprises the steps of:

detecting 159, by the data processing unit 200, at least one parameter representative of the current workout by the user on the exercise machine 100;

if said at least one parameter representative of the current workout by the user on the exercise machine 100 has reached a respective reference threshold value, blinking 160, by the data processing unit 200, the at least one light source 3 of said at least one lighting device 2, during the user's workout on the exercise machine 100, to provide an alert to the user which is representative of the need to change said control parameter of the exercise machine 100 by actuating said at least one control device 1 identified by said at least one lighting device 2.

The definition and some examples of "at least one parameter representative of the user's workout on the exercise machine" were provided earlier.

As apparent, the purpose of the invention is fully achieved because the exercise machine 100 is equipped with at least one lighting device 2 positioned on the exercise machine 100 so that, when the at least one lighting device 2 is lit, it is advantageous to identify the at least one control device 1 in a very timely, rapid and intuitive manner.

This is extremely advantageous if the exercise machine 100 is in a dark or dimly lit environment, where the at least one control device 1 may not be visible, or whether the user is doing a workout and, regardless of lighting conditions, the at least one control device 1 may not be quickly identifiable due to fatigue, tiredness or simply excessive user concentration in the course of the workout.

A person skilled in the art may make changes and adaptations to the embodiments to the exercise machine described above or can replace elements with others which are functionally equivalent to satisfy contingent needs without departing from the scope of protection of the appended claims. All the features described above as belonging to one possible embodiment may be implemented independently from the other described embodiments.

The invention claimed is:

1. An exercise machine used by a user to perform a physical activity, comprising:

at least one control device which is actuatable by the user to impart a command to the exercise machine, at least one lighting device, said at least one lighting device being positioned on the exercise machine so as to identify said at least one control device, when the at least one lighting device is lit;

a data processing unit operatively connected to said at least one lighting device and said at least one control device, said data processing unit being configured to control said at least one lighting device according to the variation of a control parameter of the exercise machine, said control parameter of the exercise machine being controllable by the user by actuating said at least one control device which is identifiable by the at least one lighting device;

wherein the data processing unit is configured to detect at least one parameter representative of the workout currently performed by the user on the exercise machine, said data processing unit being configured, if said at least one parameter representative of the workout currently performed by the user on the exercise machine has reached a respective reference threshold value, to blink the at least one light source of said at least one lighting device, during the user's workout on the exercise machine, to provide the user with an alert representative of a need to modify said control parameter of the exercise machine by actuating said at least one control device which is identifiable by said at least one lighting device.

2. An exercise machine according to claim 1, wherein the at least one lighting device comprises at least one light source and at least one light diffuser, the at least one light diffuser being positioned on the exercise machine to identify said at least one control device when the at least one light diffuser is lit.

3. An exercise machine according to claim 2, wherein the at least one light diffuser comprises a first end adapted to receive light from said at least one light source and a second end adapted to diffuse the light received by the first end.

4. An exercise machine according to claim 1, wherein the data processing unit is configured to blink the at least one light source of said at least one lighting device until, during the user's workout on the exercise machine, the control parameter of the exercise machine reaches a set reference value of said control parameter.

5. An exercise machine according to claim 1, wherein the data processing unit is configured to:

blink the at least one light source of said at least one lighting device at a set first frequency, during the user's workout on the exercise machine, until a set first workout time instant is reached at which a variation of said control parameter of the exercise machine occurs;

from said set first time instant, blink the at least one light source of said at least one lighting device at a set second frequency which is higher than the set first frequency until, during the user's workout on the exercise machine, the control parameter of the exercise machine reaches a set reference value of said control parameter.

6. An exercise machine according to claim 1, wherein the data processing unit is operatively connected to a further data processing unit, which is remote with respect to the exercise machine, said data processing unit being configured, if said data processing unit receives a respective command from the further data processing unit, to blink the at least one light source of said at least one lighting device, during the user's workout on the exercise machine, to provide the user with an alert representative of a need to modify said control parameter of the exercise machine by actuating said at least one control device which is identifiable by said at least one lighting device.

7. An exercise machine used by a user to perform a physical activity, comprising:

at least one control device which is actuatable by the user to impart a command to the exercise machine;

at least one lighting device, said at least one lighting device being positioned on the exercise machine so as to identify said at least one control device, when the at least one lighting device is lit;

wherein the at least one lighting device comprises at least one light source and at least one light diffuser, the at least one light diffuser being positioned on the exercise machine to identify said at least one control device when the at least one light diffuser is lit;

wherein the at least one light diffuser comprises a first end adapted to receive light from said at least one light source and a second end adapted to diffuse the light received by the first end;

wherein said at least one light diffuser further comprises at least one light conveying element arranged between the first end of the at least one light diffuser and the second end of the at least one light diffuser, the first end of the at least one light diffuser, the second end of the at least one light diffuser and the at least one light conveying element of the at least one light diffuser defining a respective main body having a first surface facing the at least one light source and shaped to amplify the light received from the at least one light source, said main body comprising a second surface facing an exterior of the exercise machine and shaped to diffuse the light outside of the exercise machine.

8. An exercise machine used by a user to perform a physical activity, comprising:

at least one control device which is actuatable by the user to impart a command to the exercise machine;

at least one lighting device, said at least one lighting device being positioned on the exercise machine so as to identify said at least one control device, when the at least one lighting device is lit;

wherein the at least one lighting device comprises at least one light source and at least one light diffuser, the at least one light diffuser being positioned on the exercise machine to identify said at least one control device when the at least one light diffuser is lit;

wherein the at least one light diffuser comprises a first end adapted to receive light from said at least one light source and a second end adapted to diffuse the light received by the first end;

wherein the at least one lighting device is annular so that the second end of the at least one light diffuser surrounds a portion of the exercise machine on which said at least one control device is present.

9. An exercise machine according to claim 8, wherein the at least one control device comprises a base operatively fixed to a portion of the exercise machine, having a respective longitudinal axis, the at least one control device comprising a lever operatively connected to the base, when operatively connected to the base, the lever comprising a first portion extending outside the base and a second portion extending inside the base, the operative connection of the lever to the base allows moving the first portion of lever in any operative direction of a plurality of operative directions, the movement of the first portion of the lever in a first operative direction of the plurality of operative directions corresponding to movement of the second portion of the lever in a second operative direction of the plurality of operative directions, opposite to the first operative direction, the base of the at least one control device further comprising a plurality of switches, each of the plurality of switches faces the second portion in a position to be actuated by the second portion of the lever when the second portion of the lever is moved in any one of the operative directions of the plurality of operative directions, each switch of the plurality of switches being actuatable to impart a respective command to the exercise machine.

10. An exercise machine according to claim 9, wherein the at least one lighting device comprises a plurality of light sources distributed on a respective annular support so that the at least one light device is fitted onto the base of the at least one control device, the support of the plurality of light sources being fixable to the base so that the plurality of light sources faces the exterior of the base and that a respective light is emitted by each light source of the plurality of light sources towards an exterior of the base along a direction substantially transverse to the longitudinal axis of the base.

11. An exercise machine according to claim 10, wherein the at least one light diffuser comprises at least one light conveying element arranged between the first end of the at least one light diffuser and the second end of the at least one light diffuser, the at least one light conveying element being annular in shape, the at least one light conveying element comprising a first surface which, when the at least one lighting device is operatively fixed to the base, faces the base of the at least one control device, the at least one light conveying element further comprising a respective second surface which, when the at least one lighting device is operatively fixed to the base, faces an opposite side with respect to a side on which the base is located, the first end of the at least one light diffuser comprising an annular wall which, when the at least one lighting device is operatively fixed to the base, extends parallel to the longitudinal extension axis and faces the plurality of light sources with which the at least one lighting device is provided, the annular wall having a surface shaped to convey the light received from the plurality of light sources, the second end of the at least one light diffuser comprising a plurality of light diffusers distributed along a circumference and extending orthogonally with respect to the second surface of the at least one light conveying element.

12. A method for identifying, on an exercise machine, one or more control devices of the exercise machine, comprising steps of:

providing at least one control device which is actuatable by the user to impart a command to the exercise machine;

providing at least one lighting device positioned on the exercise machine;

identifying, by said at least one lighting device, when said at least one lighting device is lit, said at least one control device;

controlling, by a data processing unit with which the exercise machine is provided, said at least one lighting device according to the variation of a control parameter of the exercise machine;

detecting, by the data processing unit, at least one parameter representative of the workout currently performed by the user on the exercise machine;

if said at least one parameter representative of the workout currently performed by the user on the exercise machine has reached a respective reference threshold value, blinking, by the data processing unit, the at least one light source of said at least one lighting device, during the user's workout on the exercise machine, to provide the user with an alert which is representative of a need to modify said control parameter of the exercise machine by actuating said at least one control device identified by said at least one lighting device.

13. A method according to claim 12, further comprising a step of blinking, by the data processing unit, at least one light source of said at least one lighting device until, during the user's workout on the exercise machine, the control parameter of the exercise machine reaches a set reference value of said control parameter.

14. A method according to claim 12, comprising steps of:

blinking, by the data processing unit, the at least one light source of said at least one lighting device at a set first frequency during the user's workout on the exercise machine, until a set first workout time instant is reached at which a variation of said control parameter of the exercise machine occurs;

from said set first time instant, blinking, by the data processing unit, the at least one light source of said at least one lighting device at a set second frequency which is higher than the set first frequency until, during the user's workout on the exercise machine, the control parameter of the exercise machine reaches a set reference value of said control parameter.

15. A method according to claim 12, further comprising a step of blinking, by the data processing unit, if the data processing unit receives a respective command from a further data processing unit which is remote with respect to the exercise machine, the at least one light source of said at least one lighting device, during the user's workout on the exercise machine, to provide the user with an alert representative of a need to modify said control parameter of the exercise machine by actuating said at least one control device with which the at least one lighting device was operatively associated.

* * * * *